US011641952B2

(12) United States Patent
Tyneski et al.

(10) Patent No.: US 11,641,952 B2
(45) Date of Patent: May 9, 2023

(54) MODULAR CRADLE

(71) Applicant: KIDS2, INC., Atlanta, GA (US)

(72) Inventors: Frank M. Tyneski, Roswell, GA (US); Franco Lodato, Sandy Springs, GA (US); Fazzio Youn, Newbury Park, CA (US)

(73) Assignee: KIDS2, INC., Atlanta, GA (US)

( * ) Notice: Subject to any disclaimer, the term of this patent is extended or adjusted under 35 U.S.C. 154(b) by 0 days.

(21) Appl. No.: 17/447,626

(22) Filed: Sep. 14, 2021

(65) Prior Publication Data

US 2021/0401190 A1 Dec. 30, 2021

Related U.S. Application Data

(63) Continuation-in-part of application No. 16/906,316, filed on Jun. 19, 2020.

(60) Provisional application No. 63/078,382, filed on Sep. 15, 2020, provisional application No. 62/865,000, filed on Jun. 21, 2019.

(51) Int. Cl.

| | |
|---|---|
| ***A47D 9/00*** | (2006.01) |
| ***A47D 1/08*** | (2006.01) |
| ***A47D 9/04*** | (2006.01) |
| ***A47D 1/10*** | (2006.01) |
| ***A47D 11/02*** | (2006.01) |
| ***A47D 1/02*** | (2006.01) |

(52) U.S. Cl.

CPC ..... *A47D 9/005* (2013.01); *A47D 1/023* (2017.05); *A47D 1/08* (2013.01); *A47D 1/10* (2013.01); *A47D 9/04* (2013.01); *A47D 11/02* (2013.01)

(58) Field of Classification Search

CPC ..... A47D 11/00; A47D 1/04; A47D 1/0085; A47D 1/10; A47D 13/105; A47D 9/005; A47D 1/08

See application file for complete search history.

(56) References Cited

U.S. PATENT DOCUMENTS

| | | | | |
|---|---|---|---|---|
| 2,560,708 A | | 3/1945 | Titus | |
| 2,494,045 A | * | 1/1950 | Kauffman | A47D 1/04 280/43.15 |
| 2,788,056 A | | 4/1957 | Parker | |
| 3,047,333 A | | 7/1962 | Stanimir | |

(Continued)

FOREIGN PATENT DOCUMENTS

| | | |
|---|---|---|
| CN | 1939790 B | 8/2010 |
| CN | 104223845 B | 4/2017 |

(Continued)

OTHER PUBLICATIONS

Chicco, Stack-3-Iln-1-Highchair, webpage, <https://www.chiccousa.com/stack-3-in-1-highchair/Stack-3-In-1-Highchair.html>.

(Continued)

*Primary Examiner* — Sarah B McPartlin
(74) *Attorney, Agent, or Firm* — Gardner Groff & Greenwald, PC

(57) ABSTRACT

A modular cradle system for children's gear includes a modular cradle assembly having a hinge frame, coupling hubs extending from the hinge frame, and a child receiving receptacle connectable with the hinge frame. The modular cradle system can be detachably coupled to various gear product bases such as a rocker base, swing, highchair, bassinet, play yard or other desired product base.

19 Claims, 23 Drawing Sheets

(56) References Cited

U.S. PATENT DOCUMENTS 3,269,771 A * 8/1966 Erdos ..... A47D 1/004 297/118
3,326,570 A 6/1967 Burnham et al.
3,331,631 A 7/1967 Pierson, Jr.
3,427,071 A 2/1969 Pierson, Jr.
RE27,255 E 12/1971 Pierson, Jr.
3,648,307 A 3/1972 Meade
3,849,812 A 11/1974 Walsh
3,883,136 A 5/1975 Kim
4,160,564 A * 7/1979 Kyle ..... A47C 3/029 297/270.3
4,664,396 A 5/1987 Pietrafesa
4,664,640 A 5/1987 Shindo et al.
4,718,715 A 1/1988 Ho
4,744,599 A 5/1988 Jankowski et al.
D297,685 S 9/1988 Wilson
4,854,638 A 8/1989 Marcus et al.
4,921,369 A 5/1990 Chew, II
4,951,997 A 8/1990 Kenney
4,968,092 A 11/1990 Giambrone
4,998,307 A 3/1991 Cone
5,010,826 A 4/1991 Kudlac
5,092,004 A 3/1992 Cone et al.
5,115,523 A 5/1992 Cone
5,165,755 A 11/1992 Rho
5,178,438 A 1/1993 Beger
5,254,007 A 10/1993 Eagan
5,294,172 A 3/1994 Dubus
5,348,374 A 9/1994 Kuo
5,413,399 A * 5/1995 Myers ..... A47D 13/105 297/130
5,558,400 A 9/1996 Poulson et al.
5,562,548 A 10/1996 Pinch et al.
5,699,564 A 12/1997 Heh
D390,905 S 2/1998 Eldon et al.
5,806,922 A 9/1998 Mendelovich
5,810,432 A 9/1998 Haut et al.
5,823,615 A 10/1998 Haut
5,868,459 A 2/1999 Welsh, Jr. et al.
5,951,102 A 9/1999 Poulson et al.
6,000,750 A 12/1999 Rossman et al.
6,089,666 A 7/2000 Rosko
6,098,217 A 8/2000 Hammil
6,123,321 A 9/2000 Miller
6,174,028 B1 1/2001 Yang et al.
D440,412 S 4/2001 Huang
6,361,106 B1 3/2002 Huang
6,416,124 B1 7/2002 Chen et al.
6,419,312 B1 7/2002 Flannery et al.
6,421,901 B2 7/2002 Sitarski et al.
6,497,452 B2 12/2002 Catelli et al.
6,511,123 B1 1/2003 Sitarski et al.
6,539,563 B1 4/2003 Hsia
6,540,292 B2 4/2003 Darling et al.
6,560,827 B1 5/2003 Gross
6,578,496 B2 6/2003 Guard et al.
6,594,840 B2 7/2003 Tomas et al.
D478,220 S 8/2003 Chang
D480,884 S 10/2003 Kane et al.
6,679,779 B2 1/2004 Tai et al.
6,682,137 B2 1/2004 Hsia
6,692,070 B1 2/2004 Hou
6,692,368 B1 2/2004 Hyun
D491,736 S 6/2004 Kane et al.
6,811,217 B2 11/2004 Kane et al.
6,851,375 B2 2/2005 Guard
6,908,398 B1 6/2005 Kang
6,994,630 B2 2/2006 Paesang
7,066,542 B2 6/2006 Wang
7,185,949 B2 3/2007 Finell
7,201,440 B2 4/2007 Heck
7,252,333 B2 8/2007 Caldwell
7,258,617 B2 8/2007 Chen
7,261,370 B1 8/2007 Whitesell, Jr.
7,318,380 B2 1/2008 Guard et al.
7,326,120 B2 2/2008 Bellows et al.
7,338,122 B2 3/2008 Hei et al.
7,419,210 B2 9/2008 Nolan et al.
7,441,835 B2 10/2008 Chen et al.
7,475,937 B2 1/2009 Mcgrew
7,490,558 B2 2/2009 Asbach et al.
7,497,461 B2 3/2009 Emerson
7,506,922 B2 3/2009 Schulte et al.
7,559,606 B2 7/2009 Hei et al.
7,563,170 B2 7/2009 Bellows et al.
7,568,758 B2 8/2009 Troutman et al.
7,621,592 B1 11/2009 Flannery
7,651,168 B2 1/2010 Kelly
7,673,934 B2 3/2010 Bearup et al.
7,673,942 B2 3/2010 Tuckey et al.
7,695,374 B2 4/2010 Bellows et al.
7,703,843 B2 4/2010 Chen et al.
7,770,970 B2 8/2010 Hei et al.
7,789,762 B2 9/2010 Greger et al.
7,832,755 B2 11/2010 Nolan et al.
7,837,570 B2 11/2010 Kwon
7,874,927 B2 1/2011 Godiska
7,878,915 B2 2/2011 Myers et al.
7,883,145 B2 2/2011 Troutman et al.
7,883,426 B2 2/2011 Bellows et al.
7,884,710 B2 2/2011 Godiska et al.
7,887,129 B2 2/2011 Hei et al.
7,896,431 B2 3/2011 Cui et al.
7,905,549 B2 3/2011 Lake et al.
7,909,400 B1 3/2011 Delaney
7,918,497 B2 4/2011 Keegan
7,918,742 B2 4/2011 Clapper et al.
7,922,244 B2 4/2011 Bearup
7,988,228 B2 8/2011 Cui et al.
8,011,722 B2 9/2011 Cui et al.
8,029,053 B2 10/2011 Troutman et al.
8,029,377 B2 10/2011 Velderman et al.
8,038,207 B2 10/2011 Flannery
8,079,639 B2 12/2011 Zeng et al.
8,142,297 B2 3/2012 Zhang
8,146,989 B2 4/2012 Godiska et al.
8,162,390 B2 4/2012 Zhong
D660,053 S 5/2012 Sclare et al.
8,177,297 B2 5/2012 Powell et al.
8,197,003 B2 * 6/2012 Rogers ..... A47C 7/407 297/130
8,201,879 B2 6/2012 Hartenstine et al.
8,205,943 B2 6/2012 Zhong
8,210,610 B2 7/2012 Berkey et al.
8,235,465 B2 8/2012 Hei et al.
8,256,833 B2 9/2012 Hu et al.
8,256,841 B2 9/2012 Hei et al.
8,276,985 B2 10/2012 Kho
8,287,044 B2 10/2012 Chen et al.
8,292,365 B2 10/2012 Lu et al.
8,297,694 B2 10/2012 Arnold, IV et al.
8,308,230 B2 11/2012 Zhong
8,308,578 B2 11/2012 Gilbert et al.
8,316,481 B2 11/2012 Arnold, IV et al.
8,321,973 B2 12/2012 Bickley
8,376,461 B2 2/2013 Chen
8,382,390 B2 2/2013 Cheng
8,398,096 B2 3/2013 Gower et al.
8,408,650 B2 4/2013 Jacobs et al.
8,469,832 B2 6/2013 Gillett et al.
8,491,402 B2 7/2013 Yeh et al.
D689,703 S 9/2013 Oren et al.
8,522,374 B2 9/2013 Sousa et al.
8,567,866 B2 10/2013 Carimati
8,590,969 B2 11/2013 Erb et al.
8,602,490 B2 12/2013 Tsai et al.
8,602,903 B2 12/2013 Gilbert
8,602,904 B2 12/2013 Tuckey et al.
8,677,533 B2 3/2014 Barron et al.
8,684,856 B2 4/2014 Pyrce et al.
8,696,055 B2 4/2014 Stolarz et al.
8,708,832 B2 4/2014 Gilbert et al.
8,746,794 B2 6/2014 Oren et al.
8,770,660 B2 7/2014 Chen et al.

(56) References Cited

U.S. PATENT DOCUMENTS 8,784,225 B2 7/2014 Burns et al.
8,795,097 B2 8/2014 Chapman et al.
8,806,673 B2 8/2014 Burkholder et al.
8,834,282 B2 9/2014 Sclare et al.
8,844,549 B2 9/2014 Mohamed
8,845,023 B2 9/2014 Chen et al.
8,845,440 B2 9/2014 Haut
8,876,617 B2 11/2014 Robbins et al.
8,893,325 B2 11/2014 Arnold, IV et al.
RE45,281 E 12/2014 Erb et al.
8,920,253 B2 12/2014 Horst et al.
8,943,622 B2 2/2015 Saint et al.
8,944,927 B2 2/2015 Huntsberger et al.
8,979,197 B2 3/2015 Cheng et al.
8,984,682 B2 3/2015 Zhao
8,985,687 B2 3/2015 Mo
9,033,417 B2 5/2015 Mo
9,033,809 B2 5/2015 Haut et al.
9,039,079 B2 5/2015 Huntsberger et al.
9,089,225 B2 7/2015 Fiore, III et al.
D737,063 S 8/2015 Lin et al.
9,101,225 B2 8/2015 Kostyniak et al.
D737,584 S 9/2015 Marcuello
9,127,709 B2 9/2015 Shan
9,155,403 B2 10/2015 Mountz et al.
9,167,911 B2 10/2015 Vlosich
D742,125 S 11/2015 Mountz et al.
9,173,503 B2 11/2015 Mountz et al.
9,200,746 B2 12/2015 Xiao
9,216,359 B2 12/2015 Gilbert
9,242,180 B2 1/2016 Gilbert et al.
9,339,118 B2 5/2016 Gubitosi et al.
9,351,587 B2 5/2016 Burns et al.
9,351,588 B2 5/2016 Burns et al.
9,364,098 B2 6/2016 Fiore, III et al.
9,399,416 B2 7/2016 Cheng et al.
9,404,528 B2 8/2016 Shan
9,414,694 B2 8/2016 Arnold, IV et al.
9,420,899 B2 8/2016 Merlo
9,480,343 B2 11/2016 Haut et al.
9,554,657 B2 1/2017 Taylor et al.
9,554,658 B2 1/2017 Horst et al.
9,585,493 B2 3/2017 Haut et al.
9,603,464 B2 3/2017 Sclare et al.
9,629,476 B1 4/2017 Robbins et al.
9,635,955 B2 5/2017 Greger
9,661,936 B2 5/2017 Lin et al.
9,675,182 B2 6/2017 Longenecker
9,693,639 B2 7/2017 Corso et al.
9,706,855 B2 7/2017 Arnold, IV et al.
9,750,351 B2 9/2017 Sack et al.
9,756,962 B2 9/2017 Perrin et al.
9,757,660 B2 9/2017 Leibovics et al.
D799,839 S 10/2017 Wanders
9,775,445 B2 10/2017 Burns et al.
9,861,209 B2 1/2018 Arnold, IV et al.
9,861,210 B2 1/2018 Tadipatri et al.
9,868,071 B2 1/2018 Gilbert et al.
9,883,749 B2 2/2018 Kostyniak et al.
9,895,005 B2 2/2018 Castilla et al.
9,907,411 B2 3/2018 Burns et al.
9,918,561 B2 3/2018 Perrin et al.
9,936,817 B2 4/2018 Horst et al.
9,955,799 B2 5/2018 Tadipatri et al.
9,968,204 B2 5/2018 Mountz et al.
9,974,396 B2 5/2018 Sozzo et al.
9,986,850 B2 6/2018 Haut et al.
10,016,068 B2 7/2018 Van Huystee et al.
10,045,635 B2 8/2018 Mountz et al.
10,051,975 B2 8/2018 Taylor et al.
10,053,131 B2 8/2018 Ruggiero et al.
10,080,443 B2 9/2018 Terhune et al.
10,092,113 B2 10/2018 Longenecker et al.
10,098,476 B2 10/2018 Winterhalter et al.
10,106,187 B1 10/2018 Farrar
10,154,738 B2 12/2018 Mountz
10,231,555 B2 3/2019 Hopke et al.
10,278,513 B2 5/2019 Kostyniak et al.
10,299,607 B2 5/2019 Kostyniak et al.
10,327,565 B2 6/2019 Sozzo et al.
10,327,566 B2 6/2019 Mountz
10,413,085 B2 9/2019 Haut
10,681,993 B2 6/2020 Mountz et al.
10,858,030 B2 12/2020 Horst
10,913,480 B2 2/2021 Gu et al.
2002/0033629 A1 3/2002 Riedl
2002/0036416 A1 3/2002 Mendenhall
2002/0074835 A1 6/2002 Chalender
2003/0218366 A1 11/2003 Rho
2005/0006930 A1 1/2005 Nolan et al.
2005/0127722 A1 6/2005 Longenecker et al.
2005/0146168 A1 7/2005 Nolan
2006/0066142 A1 3/2006 Nolan et al.
2006/0103178 A1 5/2006 Wun
2006/0225204 A1 10/2006 Bretschger
2006/0286893 A1 12/2006 Conaway
2007/0069566 A1 3/2007 Li
2007/0075525 A1 4/2007 Nolan et al.
2007/0085388 A1 4/2007 Nolan et al.
2007/0096528 A1 5/2007 Nolan et al.
2007/0145790 A1 6/2007 Ventrola
2008/0079291 A1 4/2008 Cheng
2008/0136236 A1 6/2008 Kincaid et al.
2008/0146359 A1 6/2008 Godiska
2008/0146361 A1 6/2008 Godiska
2008/0149580 A1 6/2008 Hill
2008/0150247 A1 6/2008 Lake
2008/0179921 A1 7/2008 Lake et al.
2008/0217983 A1 9/2008 Cheng
2008/0229496 A1 9/2008 Wang
2008/0290699 A1 11/2008 Golias
2009/0184547 A1 7/2009 Sclare
2009/0284050 A1 11/2009 Myers
2010/0017959 A1 1/2010 Yoshe et al.
2010/0162487 A1 7/2010 Chen et al.
2010/0231018 A1 9/2010 Arnold, IV et al.
2010/0231019 A1 9/2010 Berkey et al.
2010/0314925 A1 12/2010 Hei et al.
2011/0062676 A1 3/2011 Gower et al.
2011/0074195 A1 3/2011 Hei et al.
2011/0227384 A1 9/2011 Huntsberger et al.
2011/0260507 A1 10/2011 Parness
2012/0036635 A1 2/2012 Lapointe
2012/0267925 A1 10/2012 Hei et al.
2012/0286545 A1 11/2012 Cheng
2013/0099545 A1 4/2013 Cheng
2013/0292984 A1 11/2013 You et al.
2013/0319884 A1 12/2013 Gomez
2013/0320726 A1 12/2013 Teng
2014/0368006 A1 12/2014 Taylor et al.
2015/0137565 A1 5/2015 Kho et al.
2015/0272341 A1 10/2015 Perrin et al.
2015/0289676 A1 10/2015 Huntsberger et al.
2015/0289677 A1 10/2015 Huntsberger et al.
2015/0335170 A1 11/2015 Castilla
2016/0066708 A1 3/2016 Sclare
2016/0270556 A1 9/2016 Sack et al.
2016/0286978 A1 10/2016 Sclare et al.
2016/0309909 A1 10/2016 Costello et al.
2016/0309910 A1 10/2016 Sclare
2016/0316932 A1 11/2016 Gomez
2016/0324330 A1 11/2016 Xu
2016/0338517 A1 11/2016 Snowden
2017/0112294 A1 4/2017 Taylor et al.
2017/0196373 A1 7/2017 Sclare et al.
2017/0215600 A1 8/2017 Gunnigle
2017/0251826 A1 9/2017 Sclare et al.
2017/0251830 A1 9/2017 Sclare et al.
2017/0251831 A1 9/2017 Perrin
2018/0042399 A1 2/2018 Greger
2018/0049585 A1 2/2018 Crosby
2018/0070738 A1 3/2018 Burns et al.
2018/0070739 A1 3/2018 Arnold, IV et al.
2018/0098641 A1 4/2018 Kapanzhi et al.

(56) References Cited

U.S. PATENT DOCUMENTS

| | | | |
|---|---|---|---|
| 2018/0116423 | A1 | 5/2018 | Warjanka |
| 2018/0236904 | A1 | 8/2018 | Lehman et al. |
| 2018/0263379 | A1 | 9/2018 | Cheng |
| 2018/0279799 | A1 | 10/2018 | Ingraham et al. |
| 2018/0279800 | A1 | 10/2018 | Terhune et al. |
| 2018/0279801 | A1 | 10/2018 | Ingraham et al. |
| 2019/0059609 | A9 | 2/2019 | Sclare et al. |
| 2019/0059610 | A1 | 2/2019 | Chen |
| 2019/0059611 | A1 | 2/2019 | Burns et al. |
| 2019/0104861 | A1 | 4/2019 | Patel |
| 2019/0216230 | A1 | 7/2019 | Kostyniak et al. |
| 2019/0231087 | A1 | 8/2019 | Dziak et al. |
| 2019/0246809 | A1 | 8/2019 | Fredankey, Sr. |
| 2021/0362765 | A1 | 11/2021 | Fan et al. |

FOREIGN PATENT DOCUMENTS

| | | | | |
|---|---|---|---|---|
| CN | 108294554 | A | 7/2018 | |
| CN | 110269433 | A | 9/2019 | |
| DE | 102010037056 | A1 * | 2/2012 | ..... A47D 1/008 |
| DE | 102014118357 | B4 | 12/2018 | |
| EP | 0534215 | A1 | 3/1993 | |
| EP | 1764282 | A2 | 3/2007 | |
| EP | 3586683 | A1 | 1/2020 | |
| FR | 2992152 | B3 | 1/2015 | |
| GB | 2495965 | A | 5/2013 | |
| GB | 2517268 | B | 8/2016 | |
| WO | 1997016095 | A1 | 5/1997 | |
| WO | 2008012025 | A2 | 1/2008 | |
| WO | 2008013566 | A1 | 1/2008 | |
| WO | 2010107453 | A1 | 9/2010 | |
| WO | 2019073268 | A1 | 4/2019 | |

OTHER PUBLICATIONS

Song, Peng, Reconfigurable Interlocking Furniture (SIGGRAPH Asia 2017), Youtube video, <https://www.youtube.com/watch?v=fCGOsLpz7P8>, Aug. 26, 2017.

* cited by examiner

MODULAR CRADLE

CROSS-REFERENCE TO RELATED APPLICATION

This application is a continuation-in-part of U.S. Non-Provisional patent application Ser. No. 16/906,316 filed Jun. 19, 2020, which claims the benefit of U.S. Provisional Patent Application Ser. No. 62/865,000 filed Jun. 21, 2019; and this application also claims priority to U.S. Provisional Patent Application Ser. No. 63/078,382 filed Sep. 15, 2020, the entireties of which are hereby incorporated herein by reference for all purposes.

TECHNICAL FIELD

The present disclosure relates generally to the field of infant and children's gear, and more particularly to a modular and interchangeable cradle system for adaptation with multiple gear products.

BACKGROUND

From birth, a newborn baby requires a substantial amount of attention and care. And according to most parents experienced with raising one or more children, the first 1 to 2 years can be extremely demanding and exhaustive. Infant and children's gear products are known, for example, whether it be a rocker, bassinet, highchair, swing, and other children's gear to provide entertainment to the child and/or relief to the parent. However, known gear products are proprietary in that a specific child-receiving receptacle or seat is only compatible with a specific product base. Accordingly, it is a known problem that the den, playroom, bedroom(s), or other areas of the child's home become occupied with gear products serving various purposes and functionalities. This can become frustrating (to the parents and/or other caretakers of the child) and lead to the unused gear products being thrown away or otherwise disposed of.

In some situations, especially at a young age (e.g., 0-2 years), the parent and/or caretaker may be environments where the known configurations of gear products are inconvenient or impractical. In such situations, the parent and/or caretaker may risk placing the gear product in an unsafe location to satisfy their needs. Or, for example, the parent and/or caretaker may use the gear product less given that its known configurations are not suitable, or the unusable gear product may be discarded, either of which is wasteful and expensive.

Needs exist for improvements in the art of infant and children's gear products. It is to the provision of a modular cradle meeting these and other needs that the present disclosure is primarily directed.

SUMMARY

In example embodiments, the present disclosure provides a modular cradle system including a modular cradle assembly and two or more children's gear products for interchangeable use therewith.

In one aspect, the present disclosure relates to a modular system of children's gear including a first gear product, a second gear product, and a cradle configured for interchangeable use in a first configuration detachably coupled to the first gear product, and in a second configuration detachably coupled to the second gear product. In example embodiments, the cradle includes a frame and a support panel mounted to the frame, wherein the frame is foldable in the first configuration when coupled to the first gear product, and wherein the frame is not foldable in the second configuration when coupled to the second gear product.

In example embodiments, the first gear product is a swing and the second gear product is a highchair. In example embodiments, the cradle comprises first and second frame portions pivotally coupled to a pair of spaced-apart hub members, the hub members comprising coupling components for detachable coupling engagement with female receiving sockets of the first and second gear products.

In another aspect, the disclosure relates to a cradle for a modular system of children's gear. The cradle includes a frame having a plurality of frame elements and at least one hinged coupling between a first frame element and a second frame element, a support panel mounted to the frame, coupling means for interchangeably mounting the frame to a first gear product and a second gear product, and means for allowing the hinged coupling of the frame to fold when the cradle is coupled to the first gear product, and for preventing the hinged coupling of the frame from folding when the cradle is coupled to the second gear product.

In still another aspect, the disclosure relates to a modular cradle system including a modular cradle assembly and a reversible product base. The modular cradle assembly includes a hinge frame and a support panel mounted to the hinge frame. The reversible product base is reconfigurable between at least two modes of functionality. In example embodiments, the modular cradle assembly detachably couples with the reversible product base in a first configuration to provide a first function, and wherein the modular cradle assembly detachably coupled with the reversible product base in a second configuration to provide a second function.

In example embodiments, the reversible product base includes a pair of spaced-apart frame members, a first side of the spaced-apart frame members being generally curved for rocking on a floor surface, and a second side of the spaced-apart frame members being generally planar for remaining stable on the floor surface.

These and other aspects, features and advantages of the inventions of the present disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the disclosed inventions, and are not restrictive of the scope of invention, as claimed.

DETAILED DESCRIPTION OF EXAMPLE EMBODIMENTS

Figure 1:
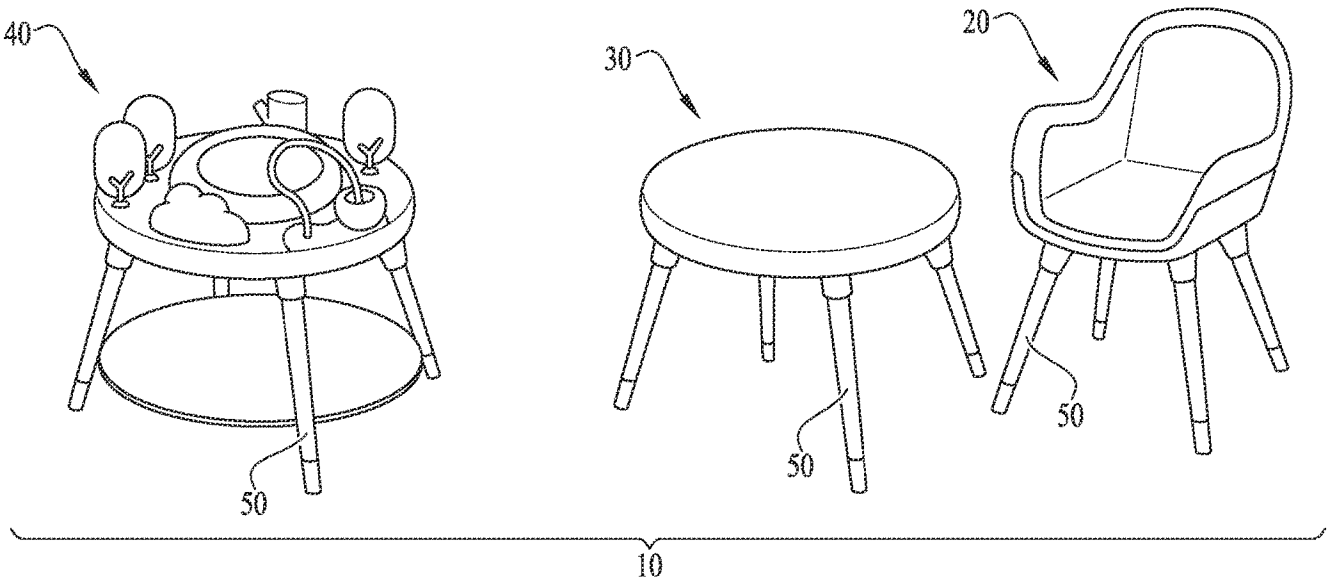
FIG. 1 is a perspective view of a modular furniture system according to an example embodiment of the present disclosure.

The present disclosure may be understood more readily by reference to the following detailed description of example embodiments taken in connection with the accompanying drawing figures, which form a part of this disclosure. It is to be understood that the inventions of the present disclosure are not limited to the specific devices, methods, conditions or parameters described and/or shown herein, and that the terminology used herein is for the purpose of describing particular embodiments by way of example only and is not intended to be limiting of the claimed scope of invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-12 show examples of modular furniture systems according to example embodiments of the present disclosure. The modular furniture systems generally comprise a plurality of support surfaces and/or a plurality of support structures. Each support structure is configured to support the support surface above the ground, floor or other support structure. In the depicted embodiments, the support surfaces are configured to hold and support a child or infant. In other embodiments, other support surfaces can be used such as tabletops. Generally, the support structures are releasably coupled to the support surface such that they can be assembled and disassembled by the user. The modular furniture system is configured such that each support surface is compatible with a variety of support structures. Similarly, each support structure can be compatible with a variety of support surfaces. Therefore, a single set of components can be configured in a variety of configurations which extends the lifespan of the products and reduces cost and waste.

In example embodiments, the seating surface and support structures are coupled together using a universal attachment method and universal attachment coupling formats. In other words, all seating surfaces and support structures in the modular furniture system can attach to one another using the same attachment mechanism. In example embodiments, the universal attachment method can comprise one or more releasable attachment mechanisms or couplings including snaps, hooks, magnets, or gravity fed attachment mechanisms. In other embodiments, the universal attachment method can comprise a semi-permanent or releasable attachment mechanism needing tools to fasten and unfasten, such as screws or nails, or allowing fastening and unfastening without by hand operation without tools. The seating surfaces are configured to comprise the universal attachment method while preserving the correct center of gravity.

Figure 2:
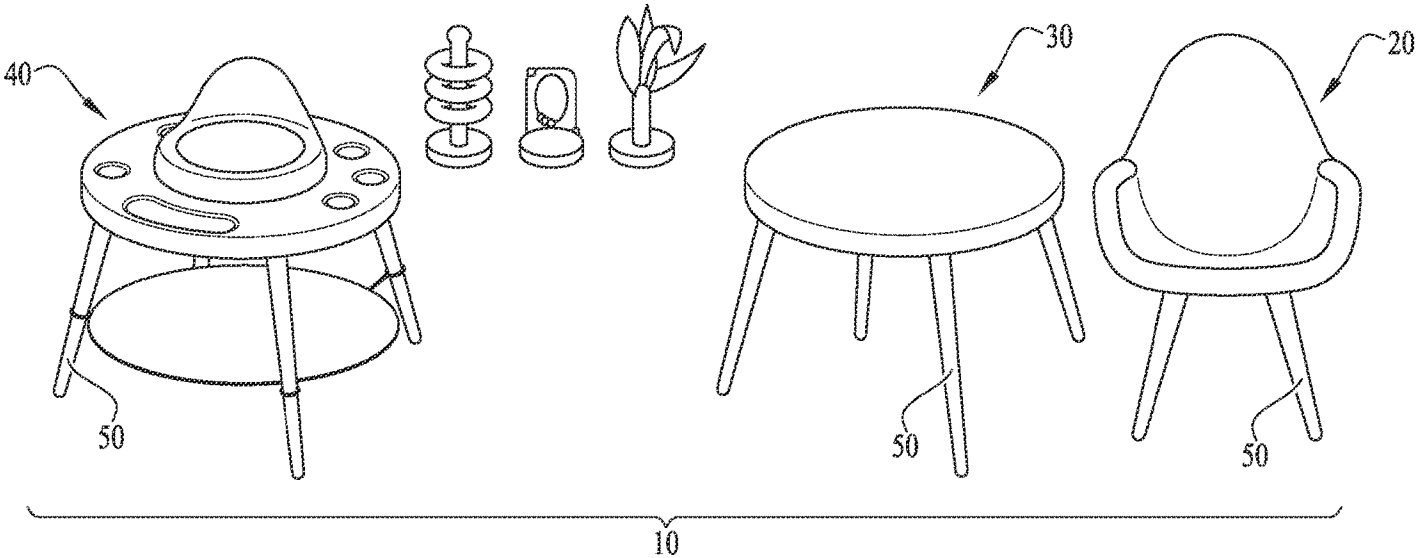
FIG. 2 is a partially disassembled view of the modular furniture system of FIG. 1.

FIGS. 1 and 2 show a modular furniture system 10 according to an example embodiment of the disclosure. In the depicted embodiment, the support surfaces include a chair 20, comprising a seating surface and a backrest, a tabletop 30, and an entertainer 40. In this system, each support surface is compatible with the same support structure. In the depicted embodiment, the support structure is a plurality of straight legs 50. Each leg is releasably attached to an attachment point on the respective support surface. In this embodiment, a caregiver can purchase the chair 20 and entertainer 40 with the respective support surface and support frames. When the child outgrows the entertainer support surface, the caregiver can exchange the entertainer support surface for the table top support surface 30 while using the same support structure legs 50.

Figure 3:
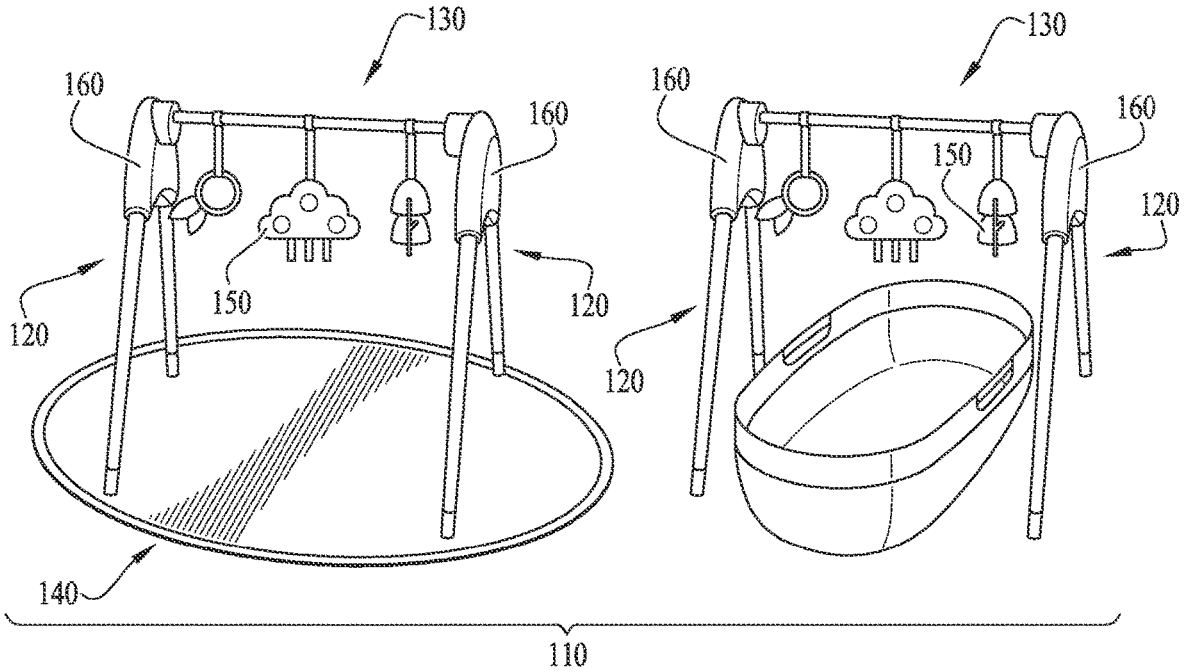
FIG. 3 is a perspective view of a modular toy bar system according to an example embodiment of the present disclosure.
Figure 4:
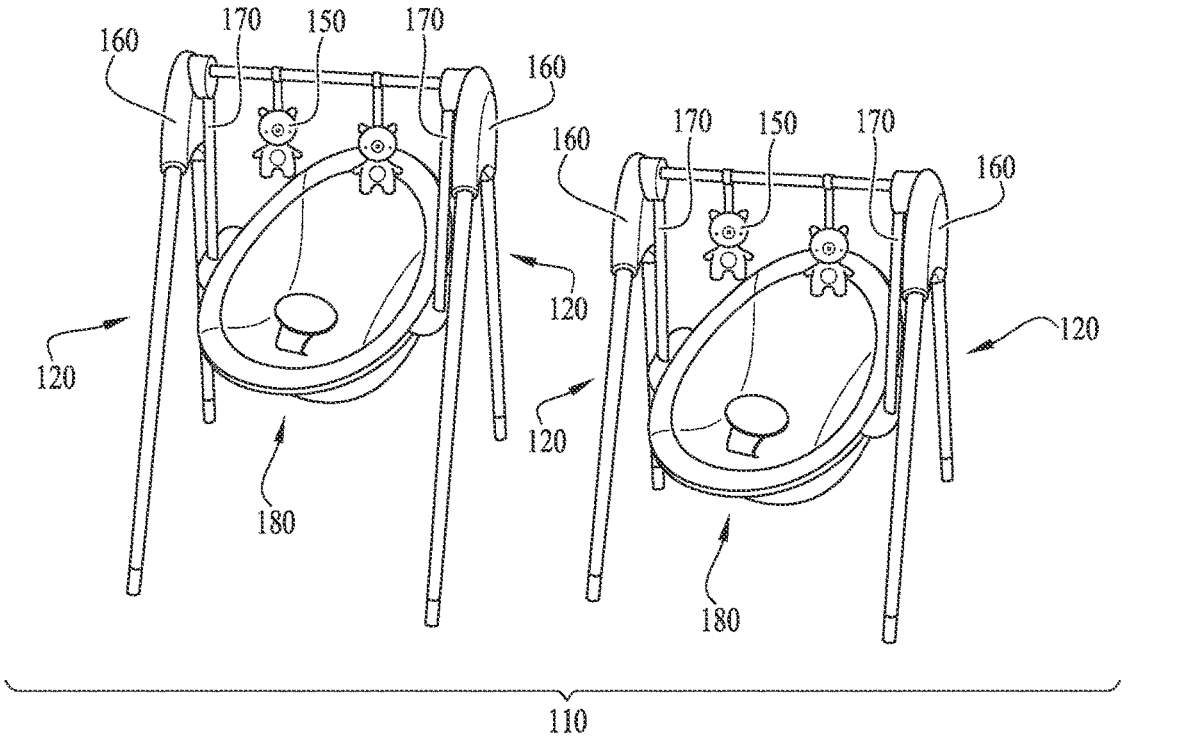
FIG. 4 is a perspective view of a modular swing system according to an example embodiment of the present disclosure.

FIGS. 3 and 4 show another modular furniture system 110 according to an example embodiment of the disclosure. In the depicted embodiment, the support structure comprises two leg structures 120 with a cross bar 130 therebetween. In the depicted embodiment, the legs 120 and cross bar 130 are coupled together using hubs. In example embodiments, the crossbar 130 of the support structure can be positioned above a child support surface 140 resting on the ground or floor in a first configuration, as shown in FIG. 3. The cross bar 130 can include hanging toys 150 such that it is used as a toy bar. In example embodiments, the legs and/or cross bar can be removably attached to the hubs 160. In this embodiment, the hubs 160 can be used with legs 120 of different sizes to vary the height of the support structure. The hubs 160 can also be used with cross bars 130 of different lengths to vary the width of the support structure. The same support structure can also include pivotal attachments for swing arms 170 to create a second, swing configuration, including a swing seat 180 as shown in FIG. 4. The support legs 120 can also be exchanged for shorter or longer support legs to vary the height of the support structure in the swing configuration.

Figure 5:
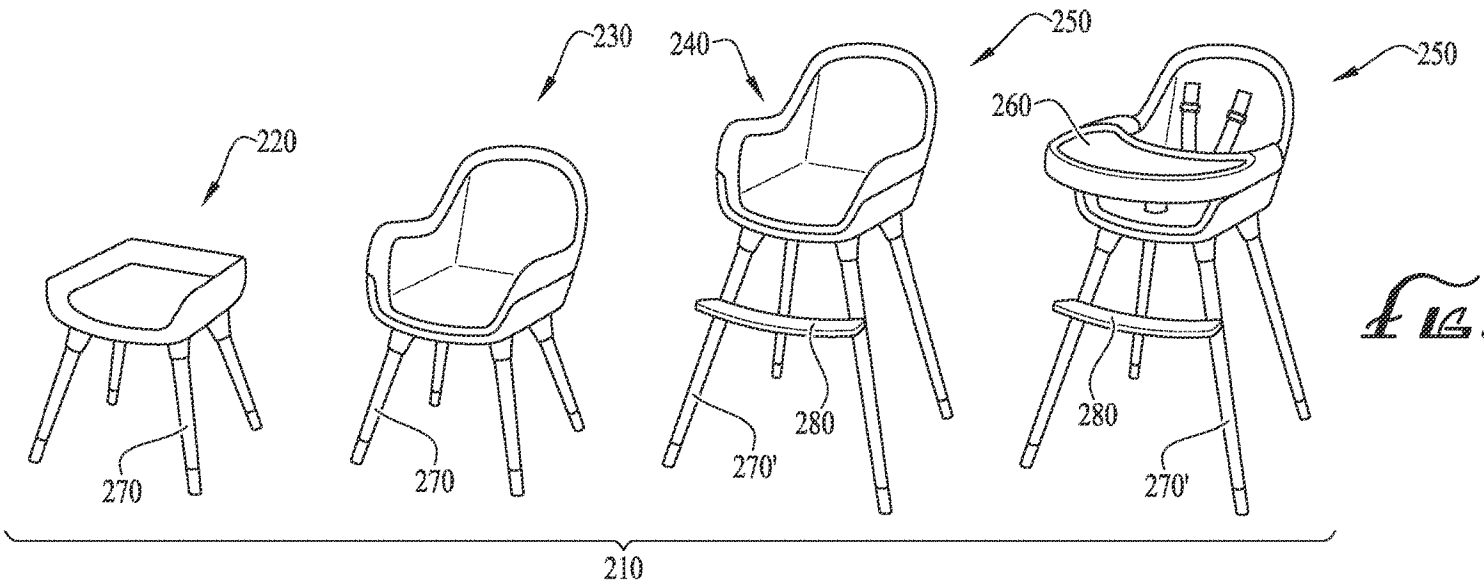
FIG. 5 is a perspective view of a modular chair system according to an example embodiment of the present disclosure.
Figure 6:
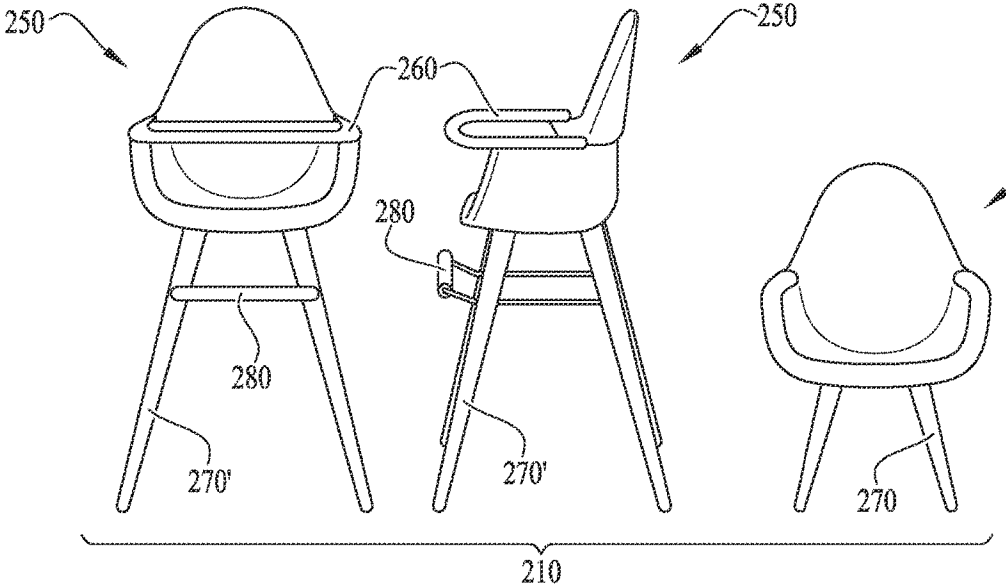
FIG. 6 is a partially disassembled view of the chair of FIG. 5.
Figure 7:
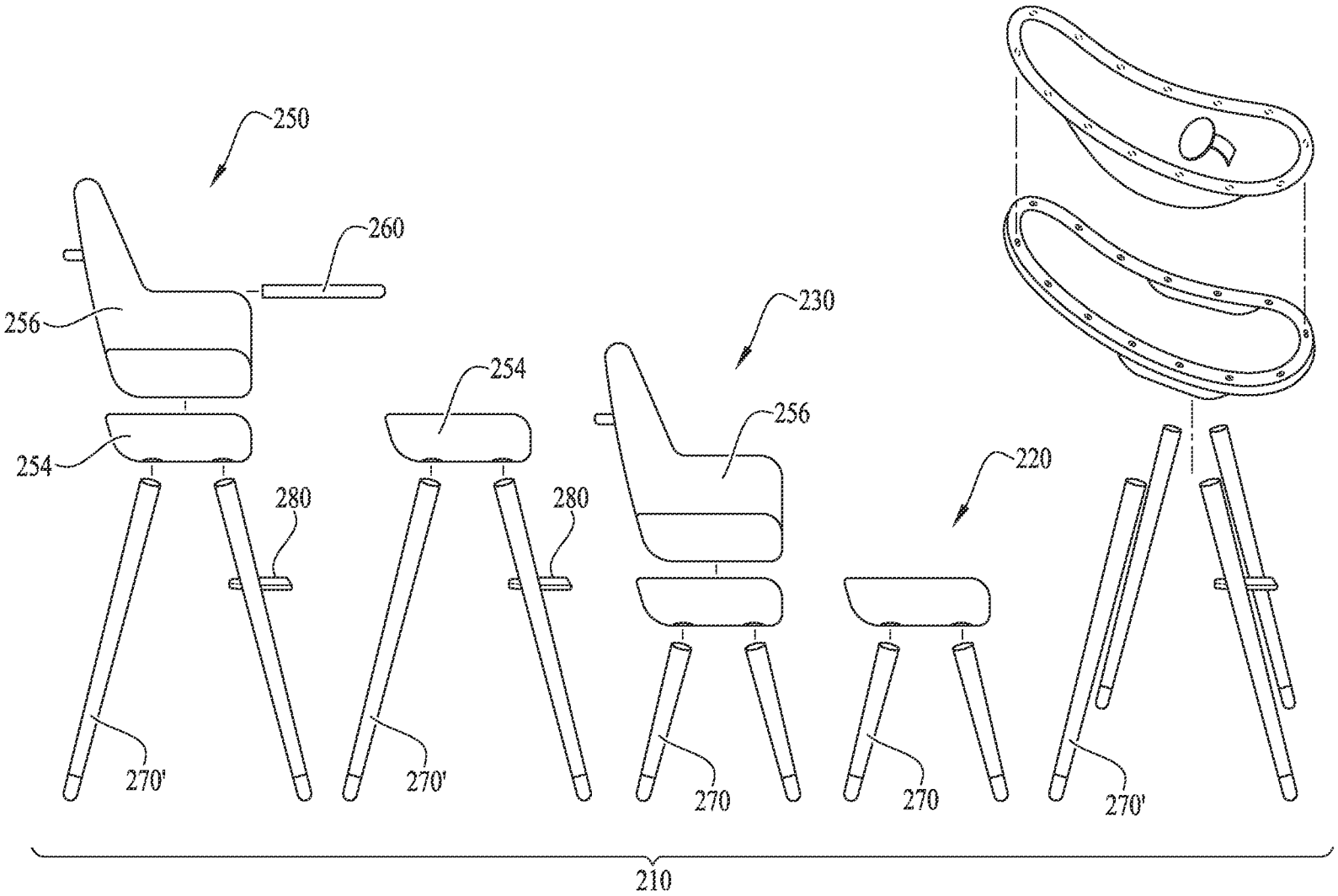
FIG. 7 is a partially disassembled side view of the chair of FIG. 5.
Figure 8:
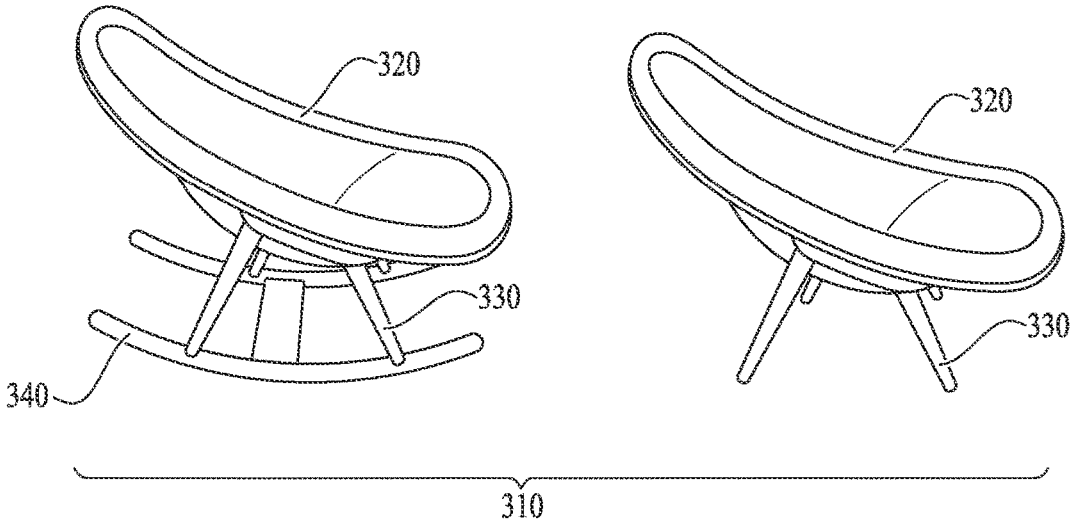
FIG. 8 is a perspective view of a modular chair system according to an example embodiment of the present disclosure.
Figure 9:
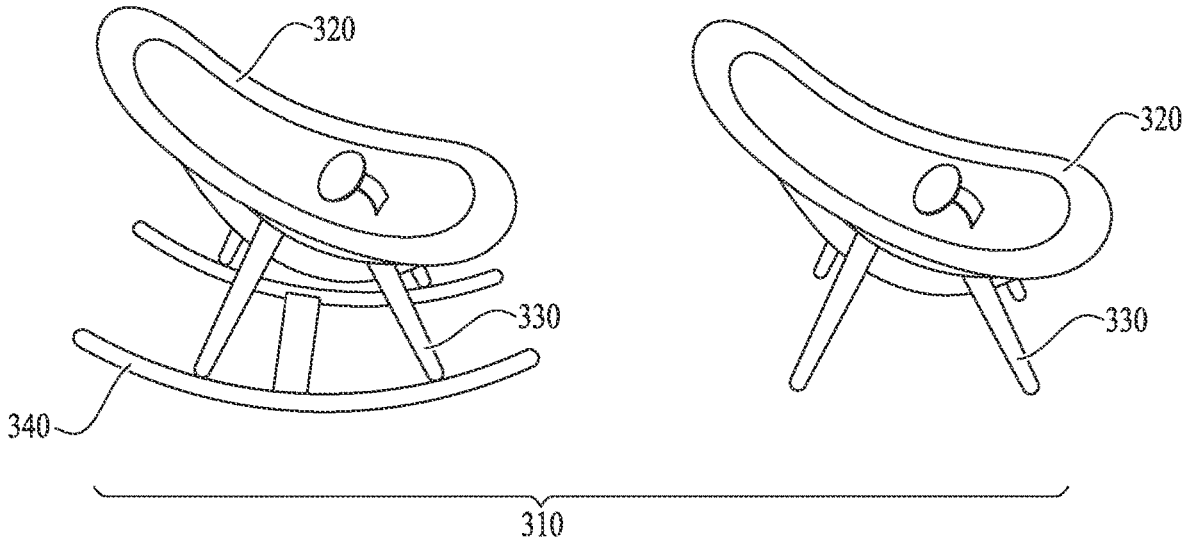
FIG. 9 is a perspective view of the modular chair system of FIG. 8.
Figure 10:
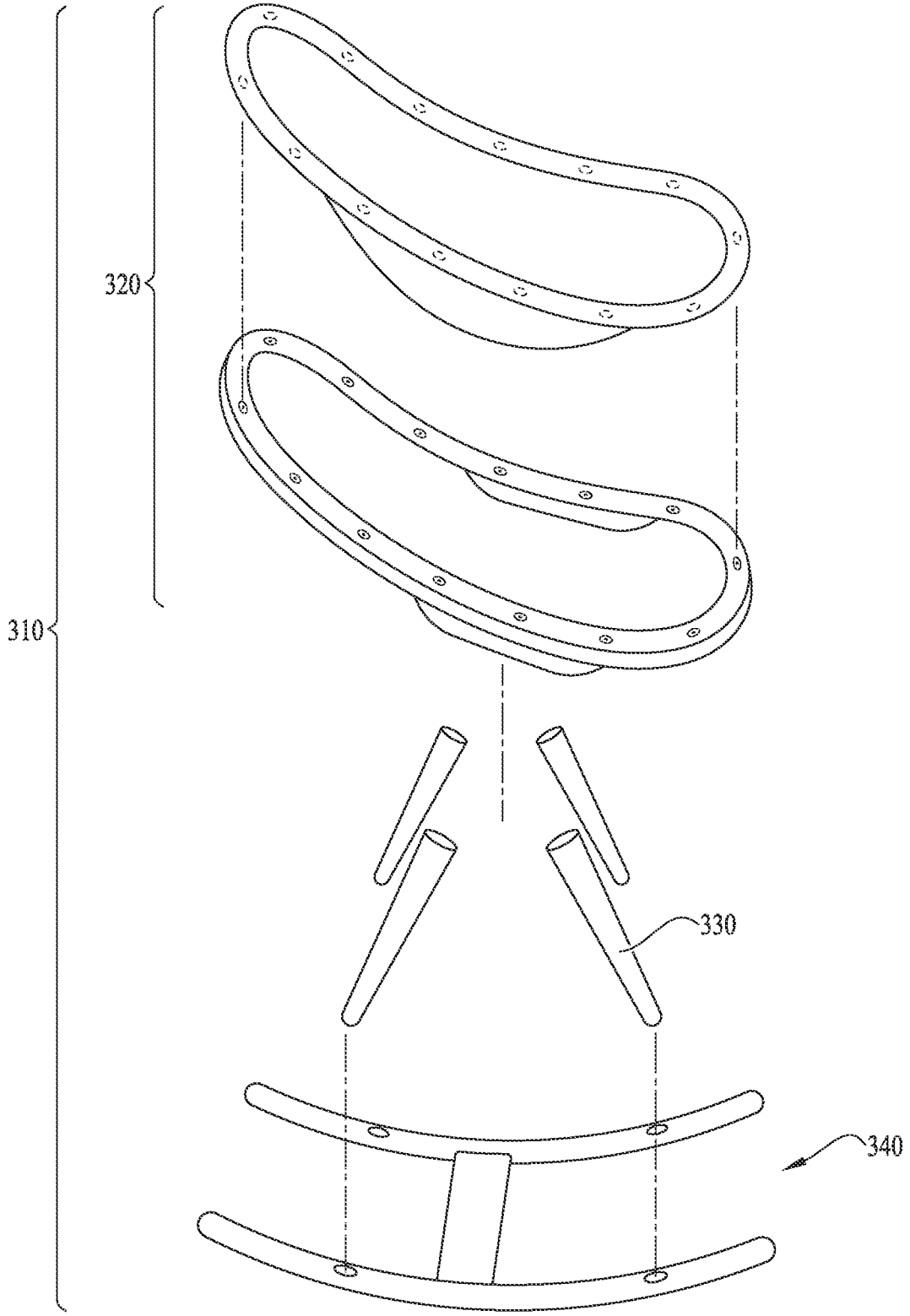
FIG. 10 is an exploded or assembly view of the modular chair system of FIG. 8.
Figure 11:
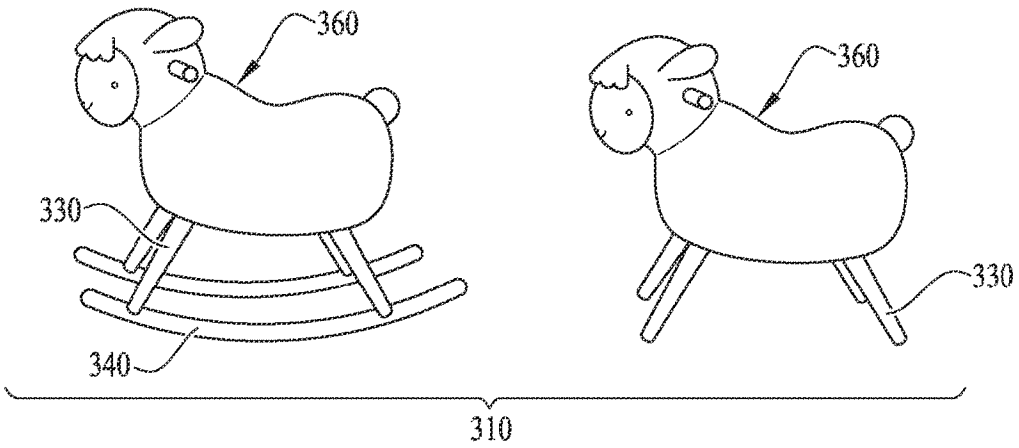
FIG. 11 is a perspective view of the modular chair system of FIG. 8, with an alternative seat.

FIGS. 5-7 show a modular furniture system 210 according to another example embodiment of the disclosure. In the depicted embodiment, the support surface can comprise a backless seating surface for use as a stool 220. The seating surface can also act as a base for a chair 230 comprising a back rest and arms. In example embodiments, the chair is releasably attached to the stool base for easy conversion between the stool configuration and chair configurations. The system can also include a chair with a crotch restraint 240 configured to prevent a child from sliding off the seating surface. In example embodiments, the system includes a detachable chair with a crotch restraint formed in the seating surface of the chair. In other embodiments, the crotch restraint is detachably coupled to the seating surface of the chair. The chair with crotch restraint can coupled to longer support legs to form a high-chair configuration 250. The high-chair 250 can optionally include a seating base 254 for use as a toddler seat, and an infant seat 256 configured for mounting to the seating base or for independent use such as for example on a standard chair. The system can also include a tray 260 that can be detachably or movably coupled to the chair. Each of the seating surface configurations are detachably coupled to one or more support structures. In the depicted embodiment, the support structures include a plurality of support legs 270, 270'. The support legs 270, 270' can vary in height. The support legs can also include accessories, such as a footrest 280 for when the modular furniture system is configured as a highchair 250. In other embodiments, the support structures can include hooks for hanging the chair from a table or other horizontal surface. The support structures can also be used with other support surfaces, such as the inclined sleeper discussed further below FIGS. 8-11 show a modular furniture system 310 according to an example embodiment of the disclosure. In the depicted embodiment, the support surface can comprise an inclined chair or sleeper 320. The support structure can comprise a plurality of support legs 330 releasably or permanently attached to the inclined seat 320. In a first configuration, the support legs 330 can rest directly on the floor or ground. In a second configuration, the support legs 330 can be releasably coupled to a rocking base 340. In the depicted embodiment, the rocking base 340 is formed from a pair of curved rockers. In other embodiments, other bases can be used to impart motion to the inclined seat, such as wheels or castors. This modular furniture design allows the inclined chair 320 to be easily converted between a stationary seat and a rocking seat, as show in FIGS. 9 and 10. The convertible support structure can be used with a variety of support surfaces. For example, the support surface can be formed in the configuration of an animal toy format, such as a rocking horse or sheep 360, which a child can sit upon.

Figure 12:
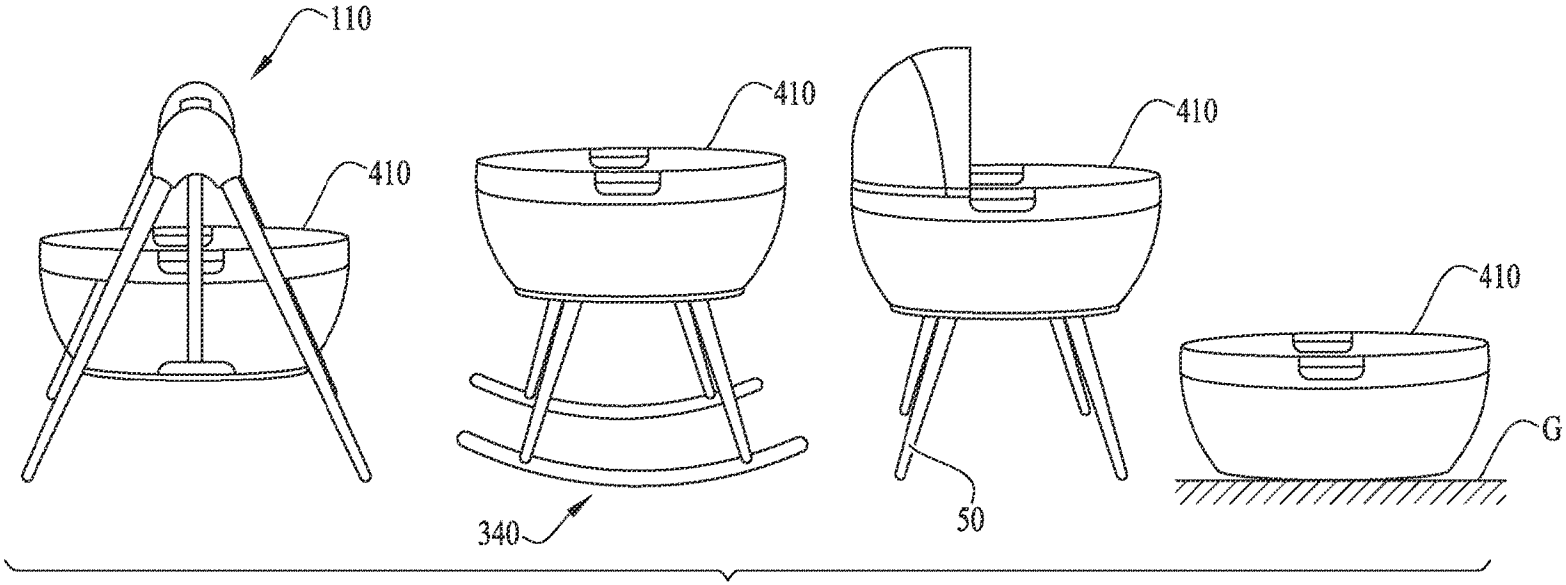
FIG. 12 is a perspective view of a modular bassinet system according to an example embodiment of the present disclosure.

FIG. 12 shows a bassinet support surface 410 that is usable with the above described convertible stationary/rocking support structure 340. As illustrated the bassinet 410 can also be coupled to the swing support structure 110 of FIG. 4, can be supported by the legs 50 of FIG. 1 or can rest directly on the floor or ground G. Therefore, the single bassinet support surface 410 is useable with at least four different support structure configurations. Additionally, the legs (50, 120, 270, 270',330), seating or support structures (20, 40, 140, 180, 254, 256, 320, 360, 410), and/or other components of the various embodiments disclosed can be the same or universally interchangeable with one another for modular compatibility.

Figure 13:
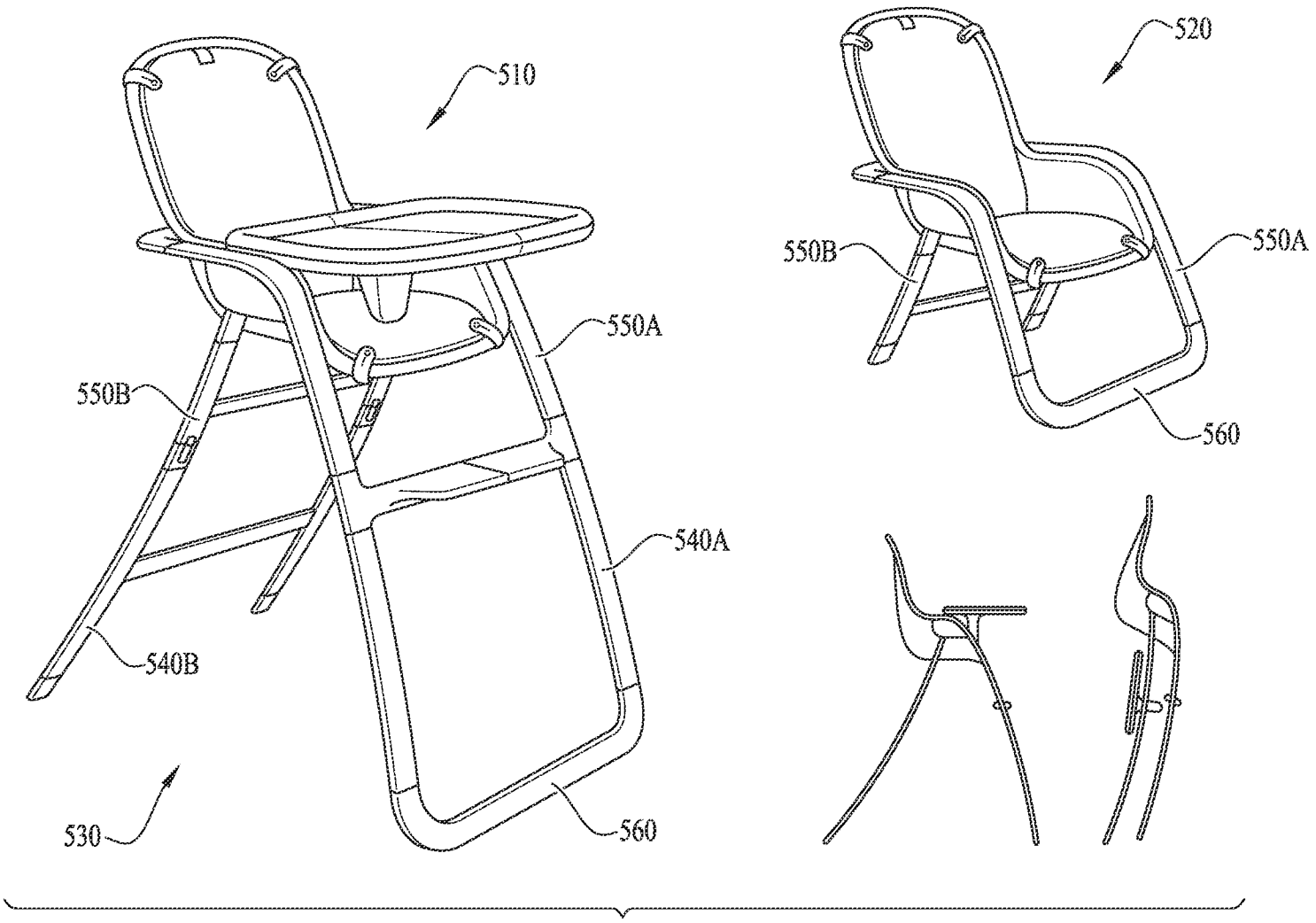
FIG. 13 is a perspective view of a modular chair system according to an example embodiment of the present disclosure.

FIG. 13 shows a chair support surface that is convertible between a high-chair 510 and a toddler seat 520. In example embodiments, the legs 530 of the high-chair 510 are formed from multiple components, for example lower leg portions or assemblies 540A, 540B and upper leg portions or assemblies 550A, 550B. The lower legs 540A, 540B can be uncoupled to convert the high-chair 510 to the lower toddler chair 520. A lower leg crossbar portion 560 may be interchangeably used in both the high-chair 510 mode and the toddler chair 520 mode. Optionally, the chair may be foldable or collapsible for compact storage as shown.

Figure 14:
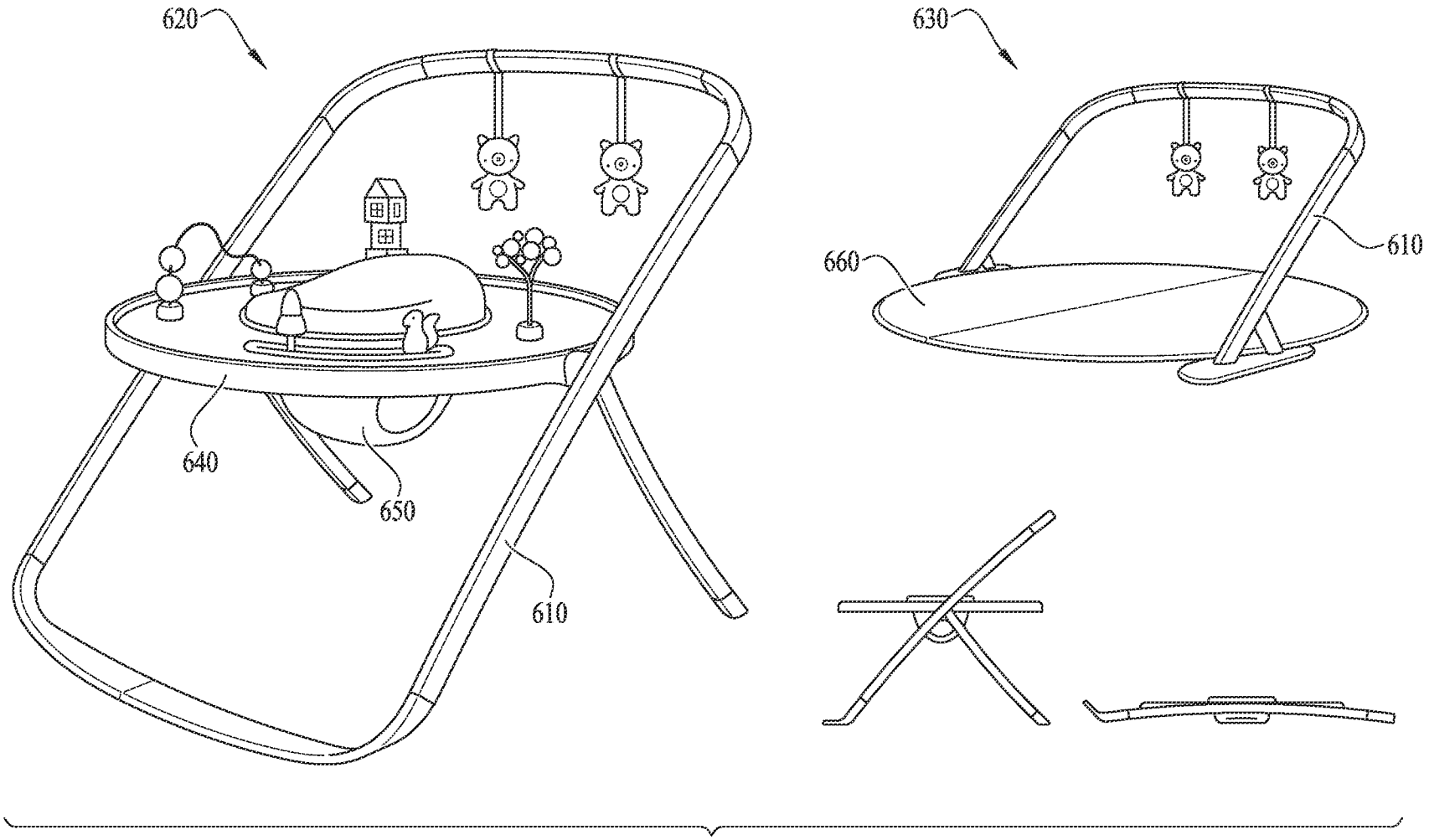
FIG. 14 is a perspective view of a modular entertainer system according to an example embodiment of the present disclosure.

FIG. 14 shows a frame 610 that is convertible between an entertainer configuration 620 and a play gym configuration 630. In one mode of use, an entertainer support surface 640 having a seat sling 650 is attached to the support structure 610 to form an infant entertainer 620. In another mode of use, a portion of the support structure 610 is positioned over a play mat 660 to form a play gym 630. Optionally, the structure 610 may be foldable or collapsible for compact storage as shown.

In an example method or mode of use, a single support surface is releasably coupled to a support frame in a first configuration. The support surface is decoupled from all or a portion of the support structure and coupled to a different support structure or support structure element, in a second configuration. In example embodiments, three or more support structure configurations are compatible with a single support surface. In another method of use, a single support structure is releasably coupled to a support surface in a first configuration. The support structure is decoupled from all or a portion of the support surface and coupled to a different support surface or support surface element, in a second configuration. In example embodiments, three or more support surfaces are compatible with a single support structure.

Figure 15B:
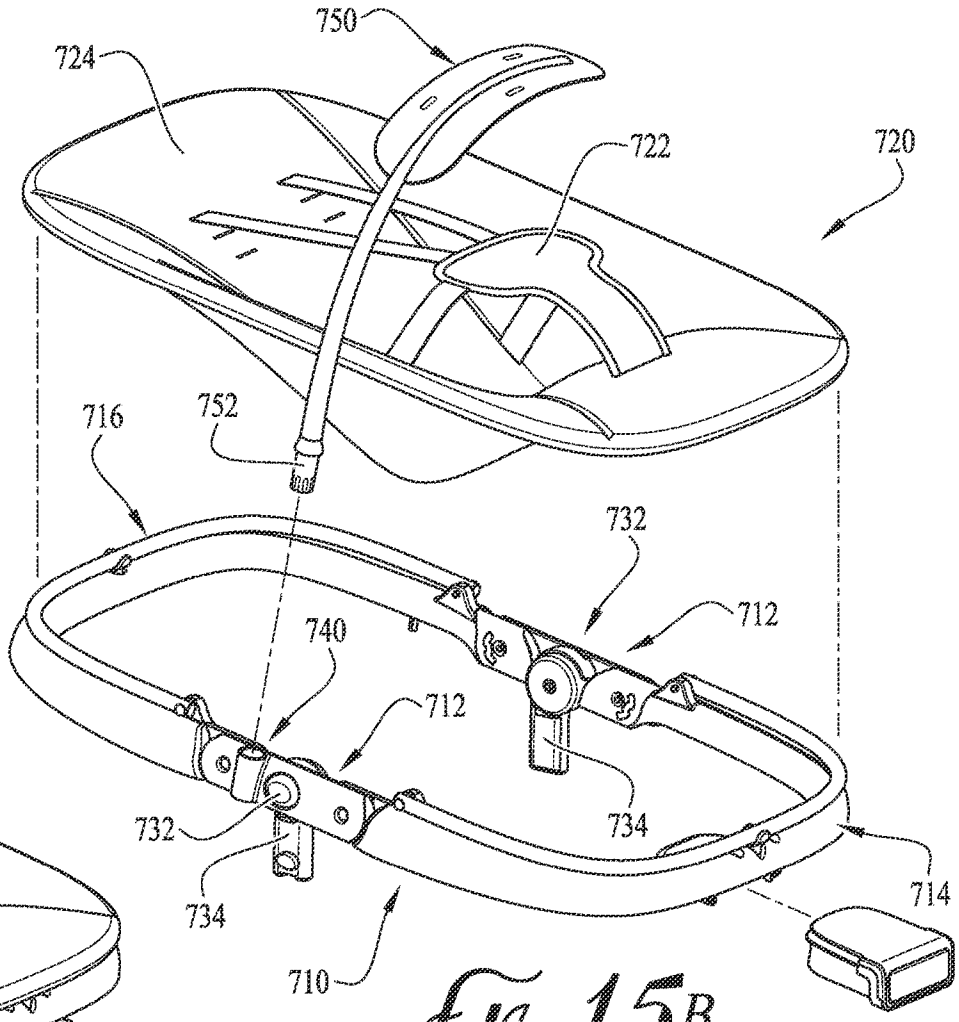
FIG. 15B is an exploded view of the modular cradle system of FIG. 15A.
Figure 15A:
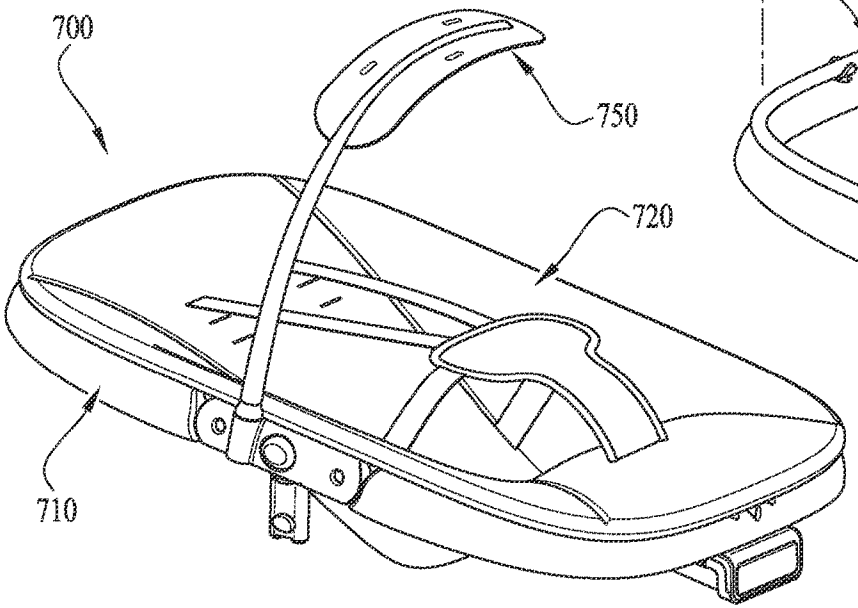
FIG. 15A is a perspective view of a modular cradle system according to an example embodiment of the present disclosure.
Figure 16:
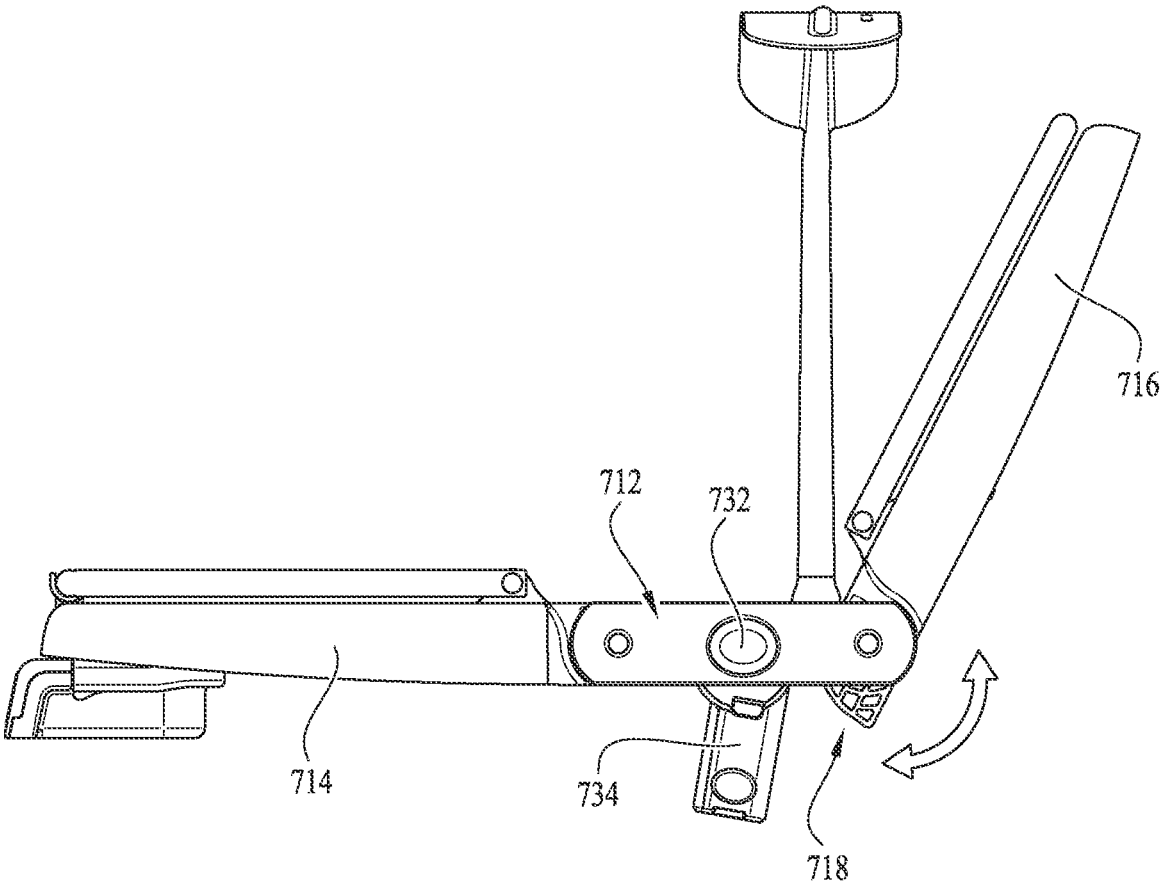
FIG. 16 shows a perspective view of a portion of the frame of the modular cradle system of FIG. 15A, showing a U-shaped frame portion pivotally mounted to a portion of a hub and extending at a position so as to expose an extension thereof for interfering with a portion of a highchair product base to prevent pivotal movement of the U-shaped frame portion when detachably coupled thereto.

FIGS. 15-32 show a plurality of examples of a modular cradle and children's accessory system comprising a modular cradle assembly (e.g., support surface and support panel) for interchangeable connection with multiple product bases or support structures (e.g., swing, rocker, highchair, and other children's support structures) according to example embodiments of the present disclosure. In example embodiments, the modular cradle assembly 700 generally comprises a hinge frame 710 and a support panel or child-receiving receptacle 720 as shown in FIGS. 15A and 15B. In example embodiments, the child receiving receptacle 720 can comprise a harness or crotch restraint 722 to secure a child to the seating surface 724. In example embodiments, the modular cradle assembly 700 is configured for interchangeable connection or detachable engagement with one or more product bases, such as for example a highchair 800 or a swing 900 shown in FIGS. 17A and 17B, respectively.

Figure 17B:
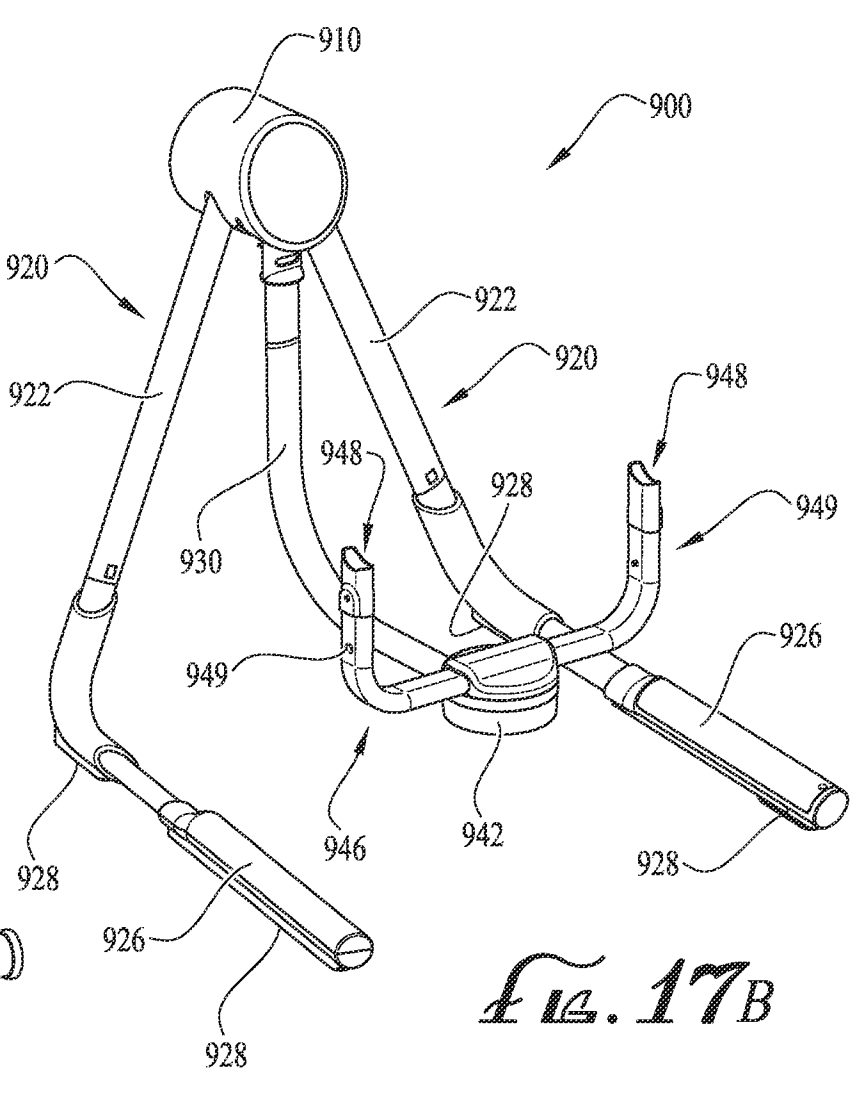
FIG. 17B shows a swing product base according to example embodiments of the present disclosure.
Figure 17A:
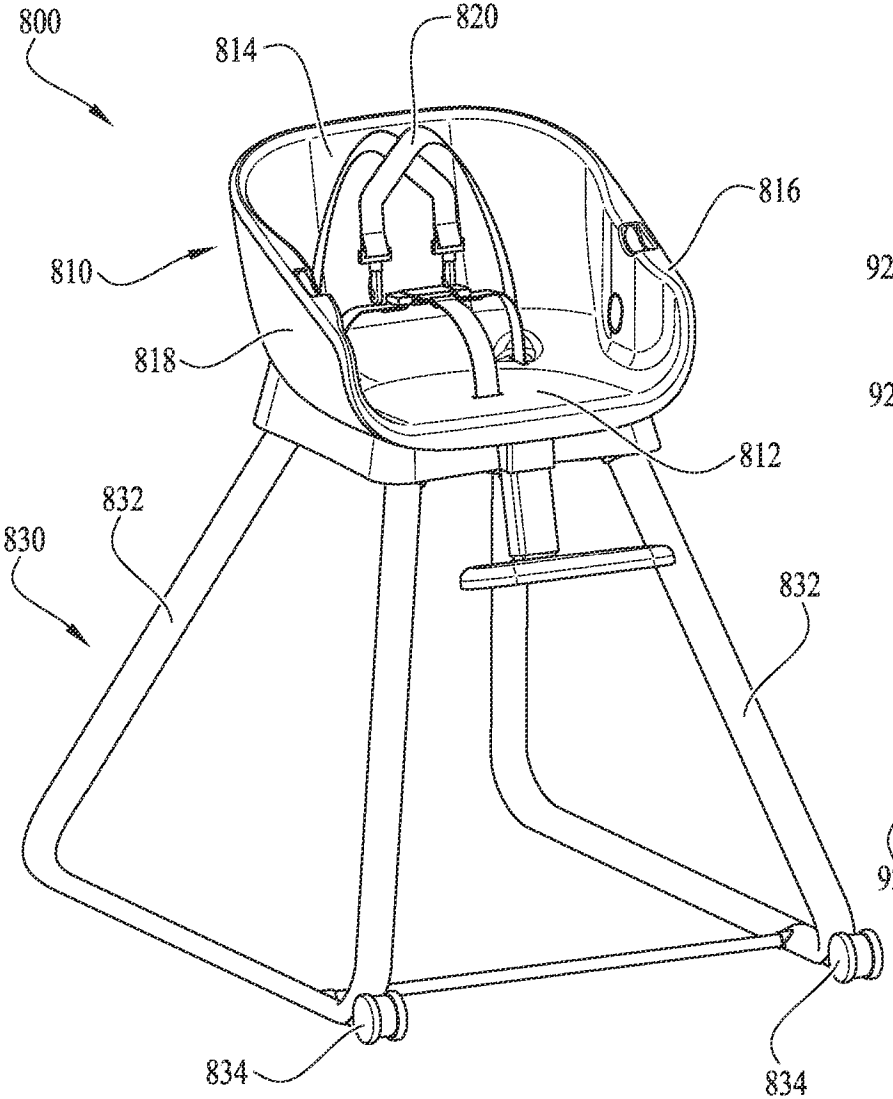
FIG. 17A shows a highchair product base according to example embodiments of the present disclosure.

FIG. 17A shows an example embodiment of the highchair 800 which is configured for cooperative engagement with the modular cradle 700. Generally, the highchair 800 comprises a seat 810 configured for receiving and securely restraining a child in a seated position and a base support portion 830 comprising one or more legs configured to support the seat and the child. In example embodiments, the seat 810 includes a bottom support or base portion 812, a back support portion 814 and left and right armrest portions 816, 818. The seat 810 can further comprise one or more safety harnesses or restraints 820 safely restrain the child in the seat 810. In the depicted embodiment, the seat 810 is supported by a pair of trapezoid-shaped legs 832 connected to an underside of the seat base 812. The support legs 832 can further comprise one or more wheels or rollers 834 which improves and/or eases the mobility of the highchair.

Figure 22:
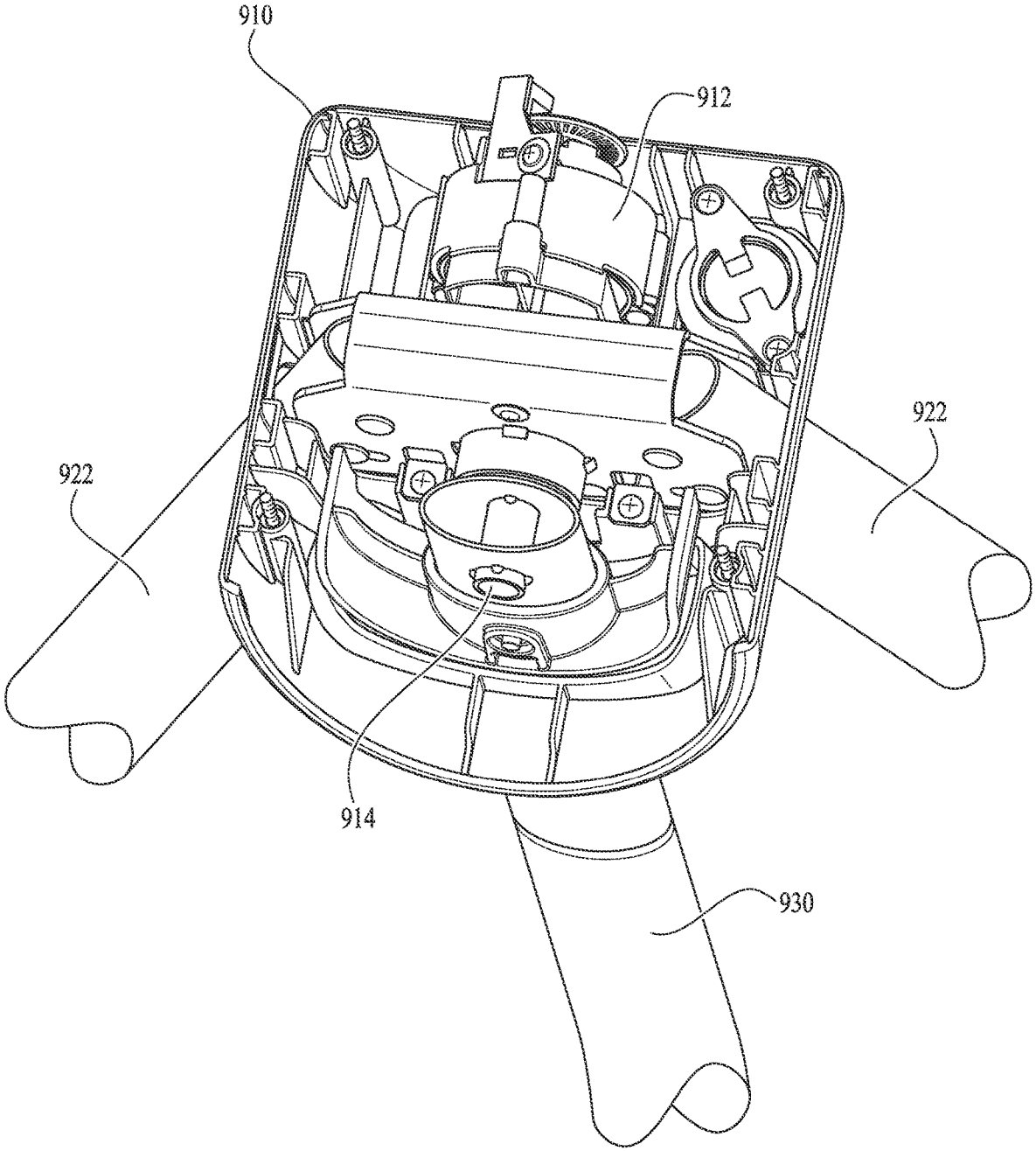
FIG. 22 shows a motor and swing arm assembly of the swing product base according to example embodiments of the present disclosure.
Figure 23A:
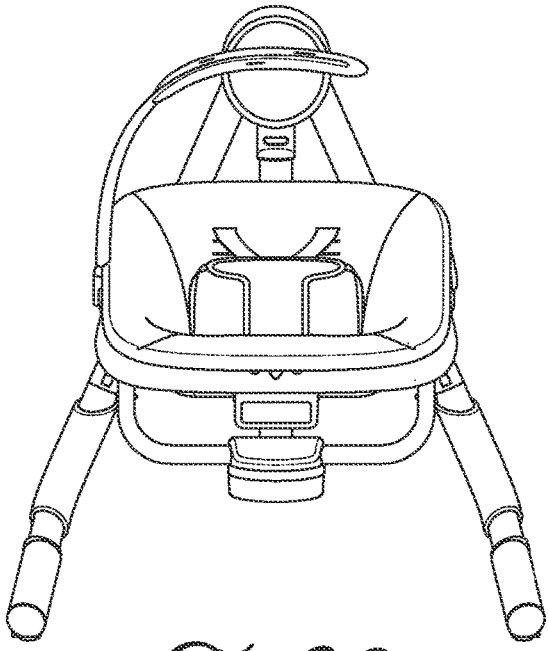
FIGS. 23A-23C show the cradle system of FIG. 15 mounted to the swing product base in various configurations according to example embodiments of the present disclosure.
Figure 23B:
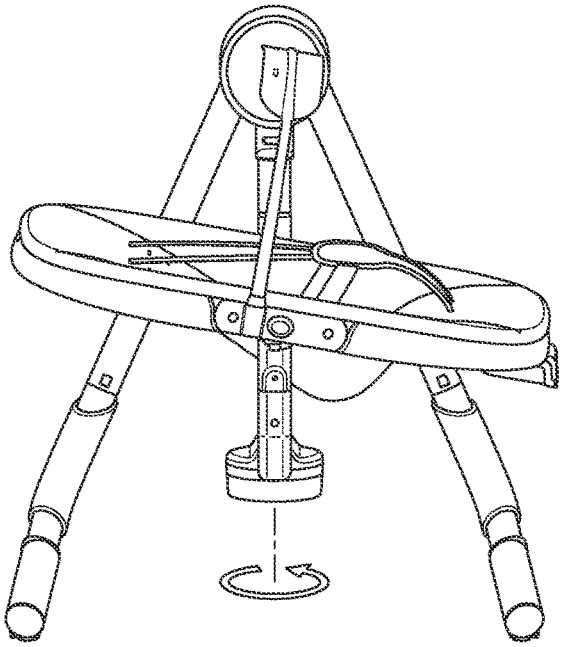
Figure 23C:
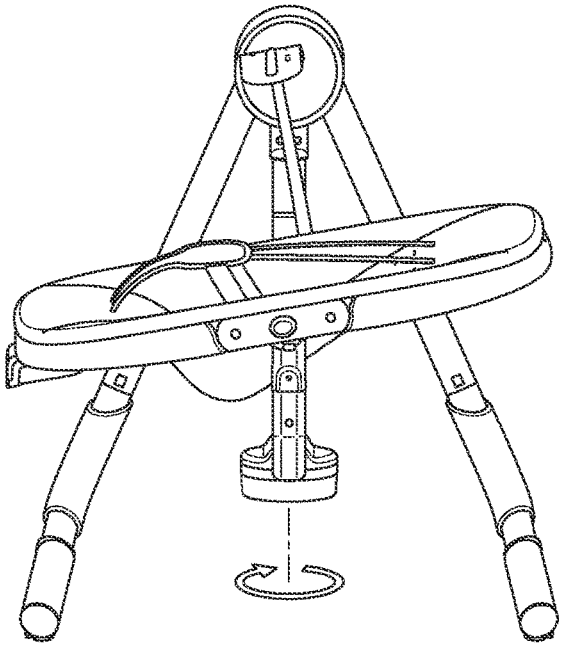

FIG. 17B shows a swing- or rocker-type product base 900 according to example embodiments of the present disclosure. Generally, the swing product base 900 comprises a motor housing 910 supported by one or more support legs 920. As shown in FIG. 22, the motor housing 910 houses therein a motor 912 with a motor axle 914. In example embodiments, a first end of a L-shaped swing arm 930 is connected to the motor axle 914 such that movement of the swing arm is driven by the motor 912. According to example embodiments, the motor 912 is configured to swing or pivot the swing arm 930 about an axial axis of the motor axle 914. At its second end, opposite the first end, the swing arm 930 comprises an upwardly-extending U-shaped frame member 946 comprising female coupling sockets 948 at each end thereof for detachably coupling with the coupling components 734 of the hubs 712 of the hinge frame 710. In example embodiments, the U-shaped frame member 946 is generally pivotally mounted to a swing arm 930 of the swing-type product base 900, for example, such that the pivotal movement or swinging of the swing arm carries the U-shaped frame member (and modular cradle assembly 700 connected thereto). For example, the swing arm 930 may comprise a pivoting base or coupling support 942 at its second end. In example embodiments, the coupling support 942 connects the U-shaped frame member 946 to the swing arm 930 and is at least partially pivotable or reconfigurable such that the orientation of the modular cradle assembly 700 can be reconfigured between a side-to-side swinging orientation (see FIG. 23A) and front-to-back swinging orientations (see FIGS. 23B-23C).

In example embodiments, the swing-type product base 900 includes two L-shaped support legs 920 extending from the motor housing 910, each of the L-shaped support legs 920 comprising, for example, a vertical portion 922 and a horizontal portion 924. In the depicted embodiments, the vertical portions 922 of the support legs extend from the motor housing 910 and apart from one another. The horizontal portions of the support legs 920 are arranged parallel to one another and can comprise one or more weights secured to the support legs 920, for example, within weight housings 926 as shown in FIG. 17B. According to example embodiments, the weights can help prevent the swing product base 900 from becoming unbalanced and falling over during use. In example embodiments, the support legs 920 can also include one or more anti-slip or protective feets 928 to prevent the swing product base 900 from inadvertently sliding across a support surface, such as for example the floor or ground.

According to example embodiments, the modular cradle assembly 700 generally comprises a hinge frame 710 and a support panel or child-receiving receptacle 720 the hinge frame 710 comprises a pair of spaced-apart frame hubs 712, a first U-shaped frame portion 714 and a second U-shaped frame portion 716. In example embodiments, the ends of the first or lower frame portion 714 and the second or upper frame portion 716 are pivotally coupled with the hubs 712 such that the hinge frame 710 defines a closed-loop frame assembly capable of selective reconfigurability (e.g., folding the first and second U-shaped frame portions to desired positions). In example embodiments, as will be described below, the hinge frame 710 is preferably substantially versatile, compatible and interchangeable. Preferably, the hinge frame 710 is capable of being reconfigured between a fully collapsed or folded configuration (e.g., for storage or transport), a fully expanded configuration, and any configuration therebetween (e.g., one or more portions thereof being at least partially pivoted or reconfigured for alternate seating/receiving positions, as shown in FIG. 15C). In example embodiments, in the fully collapsed configuration, the first and second U-shaped portions 714, 716 generally extend in a direction perpendicular relative to the extension of the portions of the hubs 712 pivotally mounted thereto. In the fully expanded configuration, the ends of the first and second U-shaped portions 714, 716 extend generally coaxial and are generally aligned relatively parallel relative to the extension of the portions of the hubs 712 pivotally mounted thereto. According to example embodiments, the first and second frame portions 714, 716 are pivotally coupled to the frame hubs 712 and are configured to allow incremental adjustment of the frame portions between the fully extended configuration and the fully collapsed configuration. In example embodiments, a central button 732 is provided with each portion of the frame hubs 712 that pivotally receives the ends of the first and second frame portions, for example, which preferably allows for incremental adjustment to the positions of the first and second U-shaped portions between the fully extended configuration and the fully collapsed configuration.

Figure 18B:
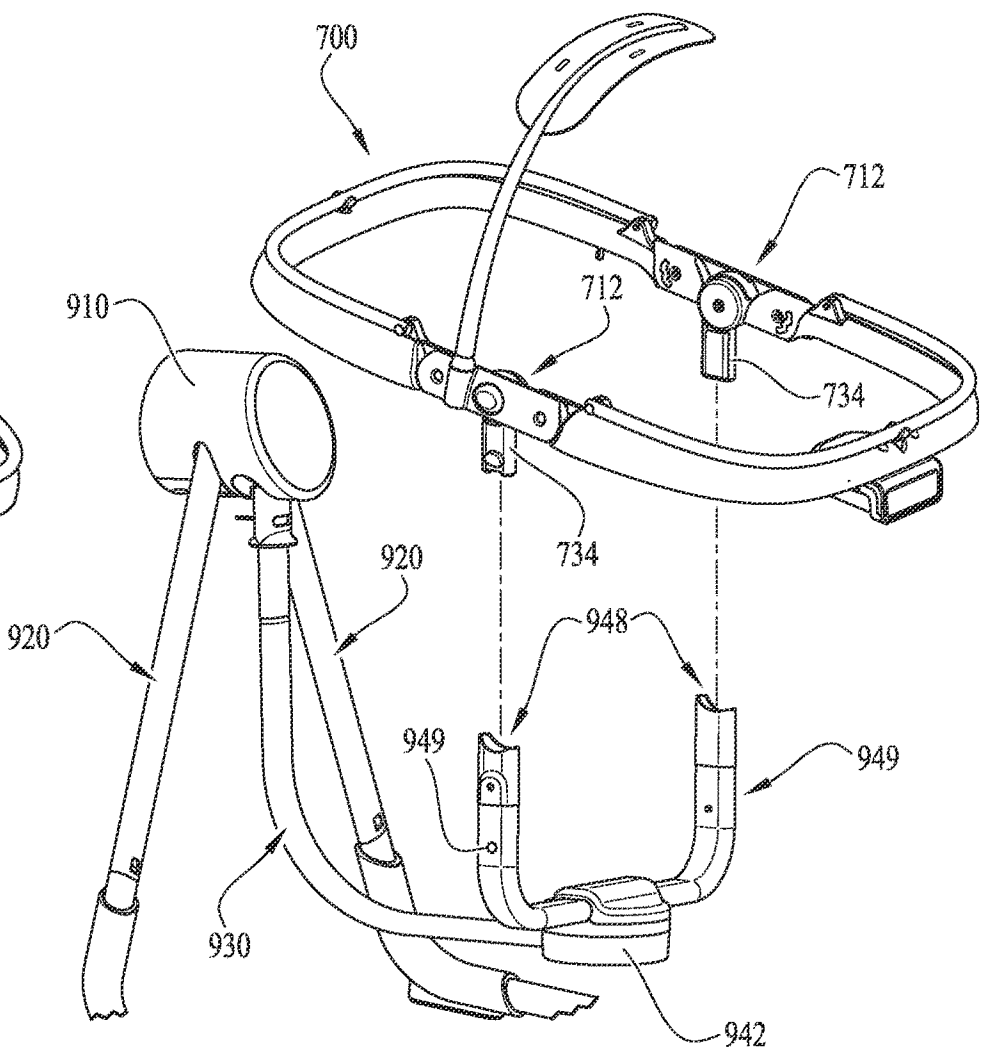
FIGS. 18A-18B shows the frame of the modular cradle system of FIG. 15A, showing compatibility of the frame for coupling on product bases of FIGS. 17A and 17B according to example embodiments of the present disclosure.
Figure 18A:
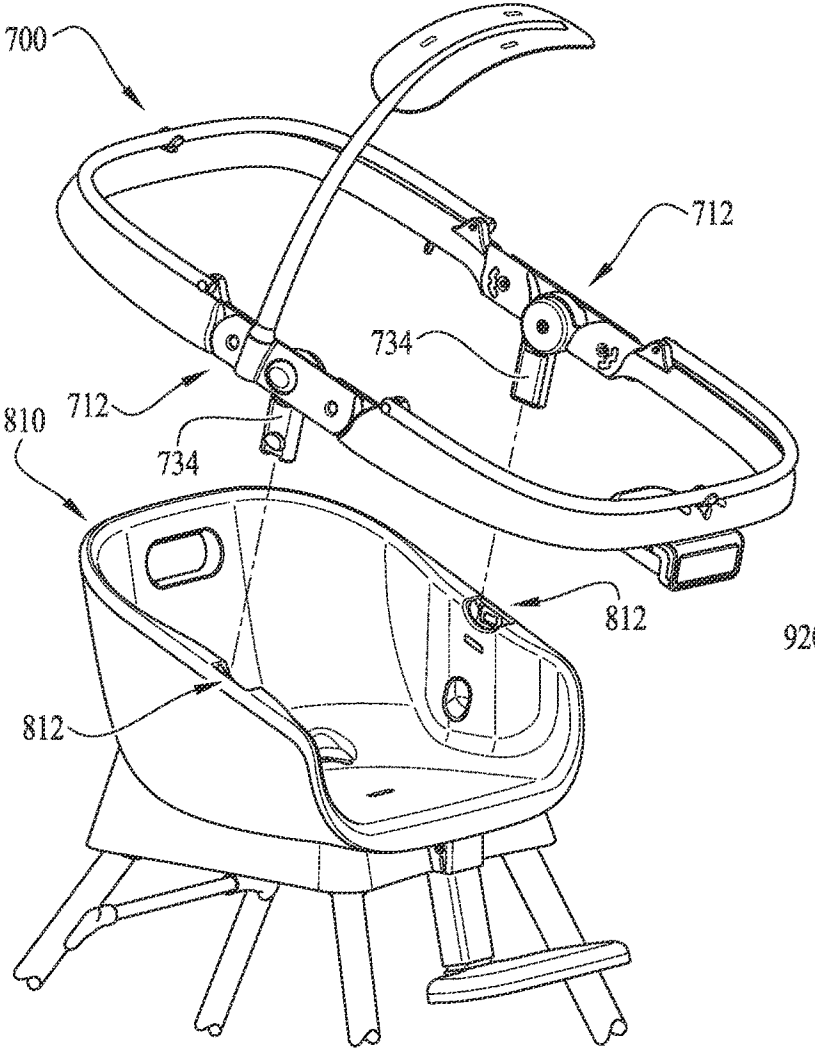

According to example embodiments, each hub comprises a stem or coupling component 734 so as to permit the modular cradle assembly 700 to detachably mount with multiple support structures. As shown in FIGS. 18A and 18B, the coupling components of the hinge frame are configured to be detachably connected with one or more sockets formed in or provided on the support structures (e.g., highchair/swing). For example, the highchair 800 comprises a pair of female coupling sockets 812 formed with or in the seat 810 thereof. In example embodiments, a first female coupling socket 812 is formed in the right armrest portion of the highchair seat 810 and a second female coupling socket 812 is formed in the left armrest portion of the seat 810.

Figure 19B:
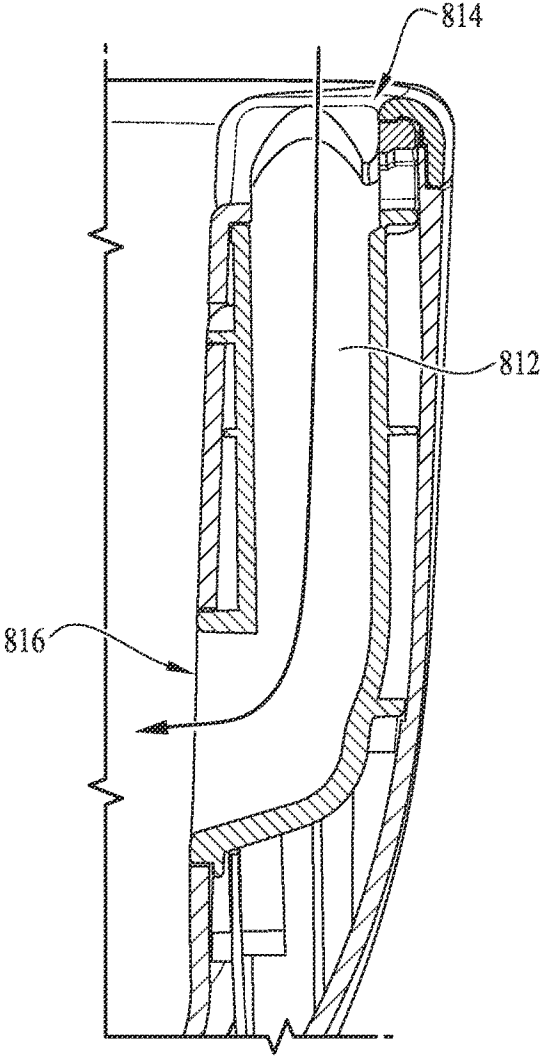
FIG. 19B shows a cross-sectional view of one coupling socket according to an example embodiment of the present disclosure, showing a drain or chute so as to allow foodstuff to pass therethrough and not accumulate.
Figure 19A:
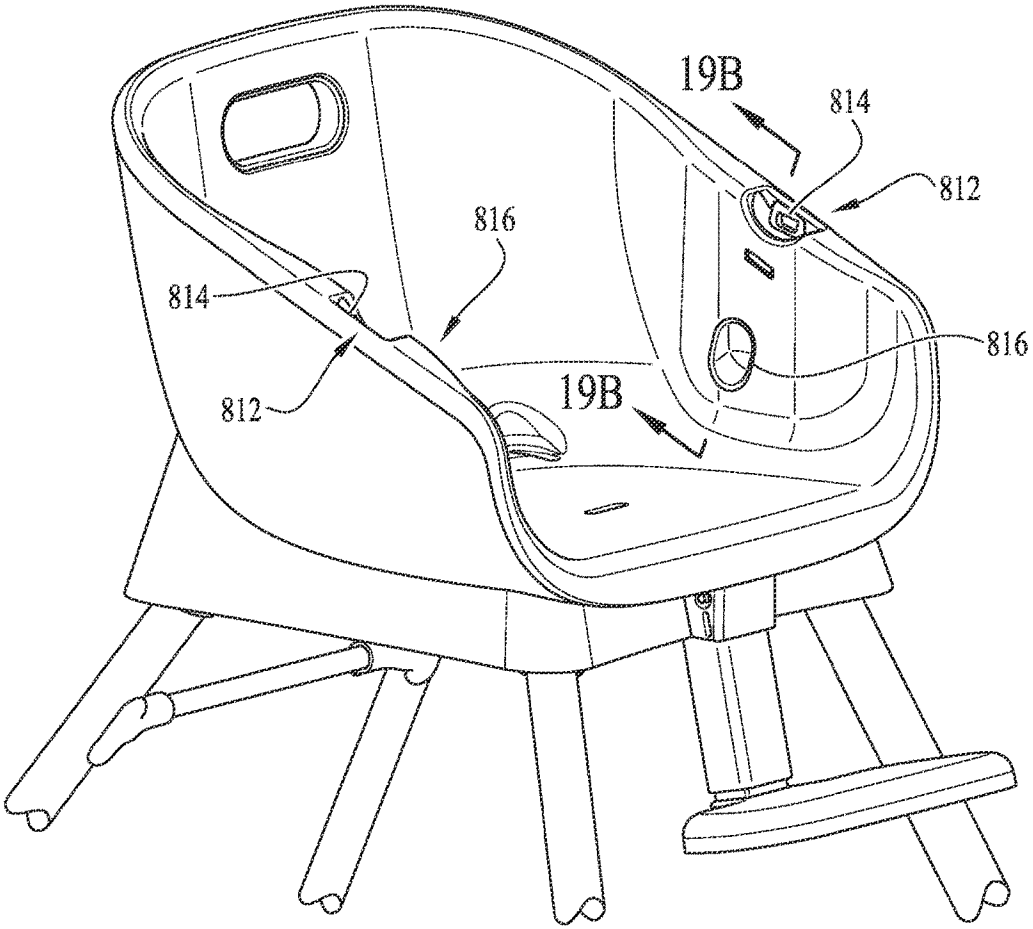
FIG. 19A shows a perspective view of a seat of the highchair product base and coupling sockets provided thereon according to an example embodiment of the present disclosure.

As shown in FIGS. 19A and 19B, the female coupling sockets 812 are preferably formed in armrest or sidewall portions of the seat 810 of the highchair 800, for example, wherein passthrough openings 814 formed therewith define an opening or channel extending entirely through the female coupling sockets. In example embodiments, the female coupling sockets 812 comprise first ends or openings 814 configured for receiving coupling components 734 of the hubs 712 of hinge frame 710. The female coupling sockets further comprise second ends or exits 816 provided generally opposite of the first ends 814 and is in communication with the first ends. In example embodiments, the entirely open channel or passthrough of the female coupling sockets 812 of the highchair preferably provide a chute for food or other objects, components, and toys, to pass though, and facilitate cleaning, for example, which may be unintentionally inserted therein when a child is being supported by the highchair and with the female coupling sockets being unoccupied and accessible.

Figure 20A:
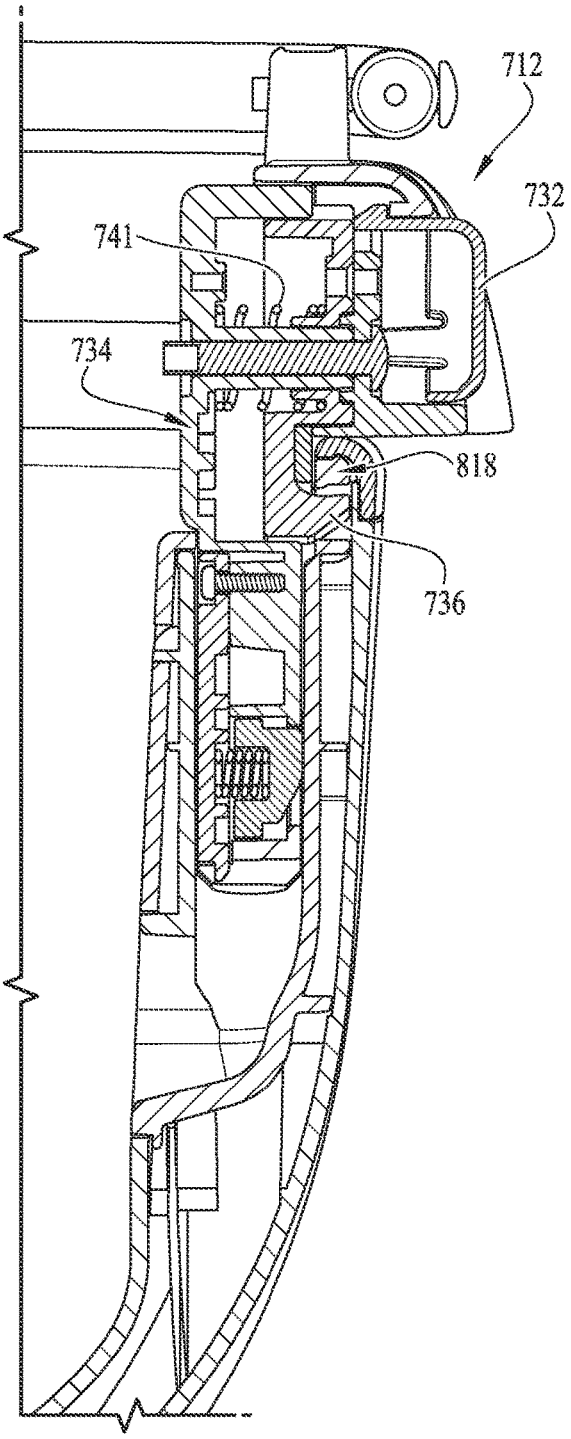
FIGS. 20A and 20B show a detailed cross-sectional view of a portion of a locking mechanism of a frame of the modular cradle system of FIG. 15 according to an example embodiment of the present disclosure, showing the locking mechanism engaged with the highchair product base of FIG. 17A.
Figure 20B:
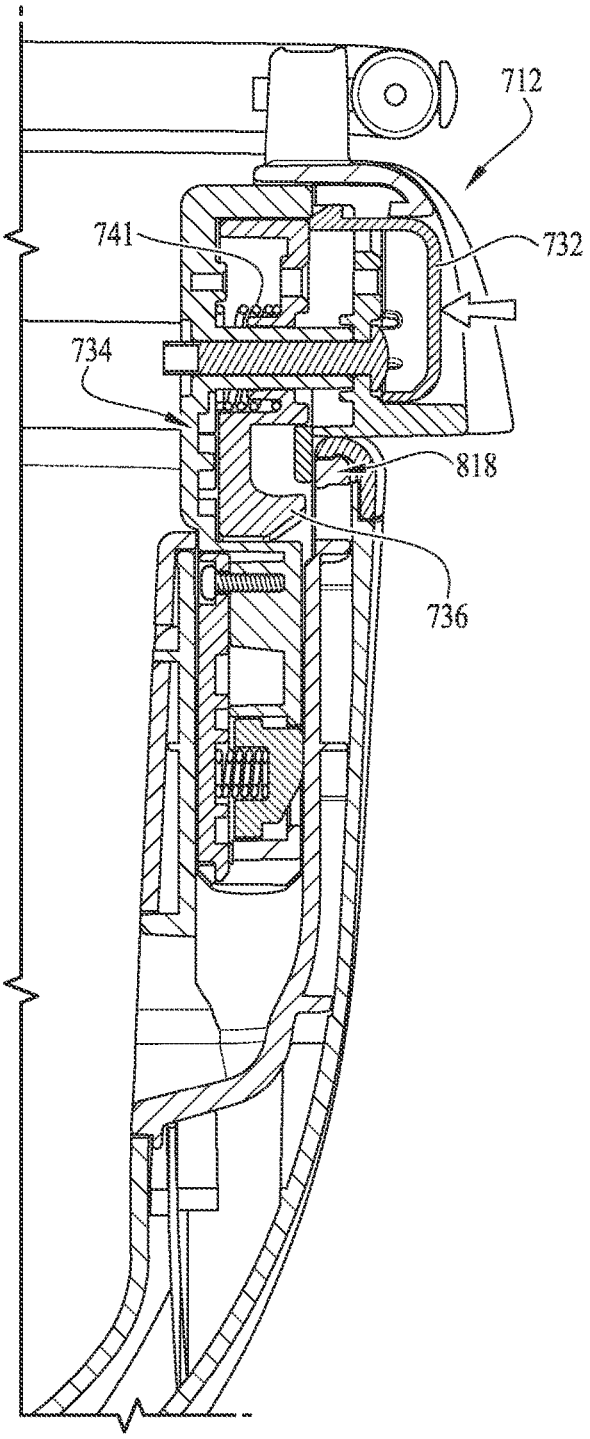

In example embodiments, the coupling components of the hubs are configured to inter-engage female coupling sockets of various product bases, and to selectively permit other functionalities of the hinge frame, for example, such as folding the same. For example, FIGS. 20A and 20B show a detailed view of the inter-engagement between the coupling component 734 of hub 710 and the female coupling socket 812 of highchair product base 800 according to example embodiments of the present disclosure. According to example embodiments, the hub comprises an internal catch member 736 that is biased, for example by a spring or other biasing mechanism 815, to cause a finger catch thereof to interfere with or catch onto an overhang 818 formed along a portion of the female coupling socket 812. Thus, in this configuration, the hinge frame 700 is prevented from disengagement from the female coupling sockets 812 of the highchair product base 800 (see FIGS. 20A-20B). In example embodiments, a release button 732 is provided within the hub 712 and is operably or integrally connected to the internal catch member 726 wherein actuation of the release button 732 actuates the finger catch of the internal catch member. As depicted, pressing inwardly on the release button 732 causes removal of the finger catch 736 from the overhang 818, thereby permitting disengagement of the hinge frame 700 from the highchair product base 800. In some example embodiments, an actuatable button or other operable mechanisms may be provided on at least one of the hubs of the hinge frame to permit selective folding of the hinge frame.

According to example embodiments, the first and second U-shaped portions 714, 716 comprise fingers or interference members or extensions 718 extending at each of their respective ends thereof (see FIG. 16), for example, so as to cause interference with a portion of the product base while engaged with the female sockets thereof. Accordingly, when the coupling components 734 of the hub assemblies 712 are coupled with the female coupling sockets 812 of the highchair product base 800, the first and second U-shaped portions are prevented from pivoting (e.g., due to interference of the extensions with portions of the product base) such that the hinge frame must remain in a fully collapsed or extended configuration. In other words, when the hinge frame 700 is secured to the highchair base 800, the hinge frame 700 is prevented from being folded, for example, such that the first and second U-shaped portions are prevented from pivoting or folding relative to the hub of the hinge frame.

Figure 21A:
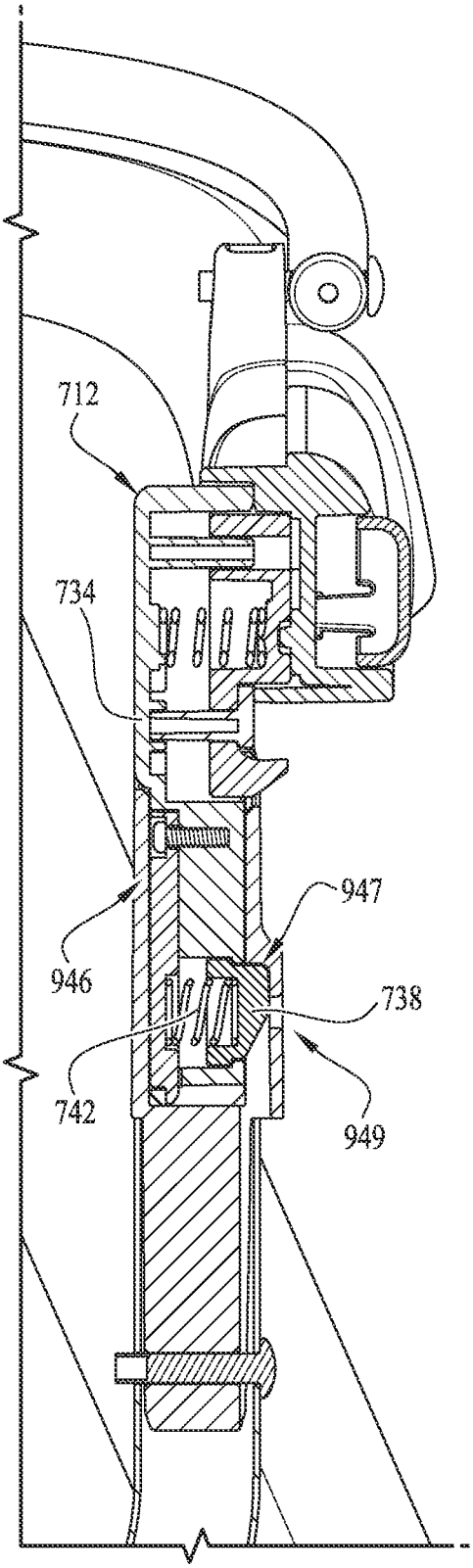
FIGS. 21A and 21B show a detailed cross-sectional view of a portion of a locking mechanism of a frame of the modular cradle system of FIG. 15 according to an example embodiment of the present disclosure, showing the locking mechanism engaged with the swing product base of FIG. 17B.
Figure 21B:
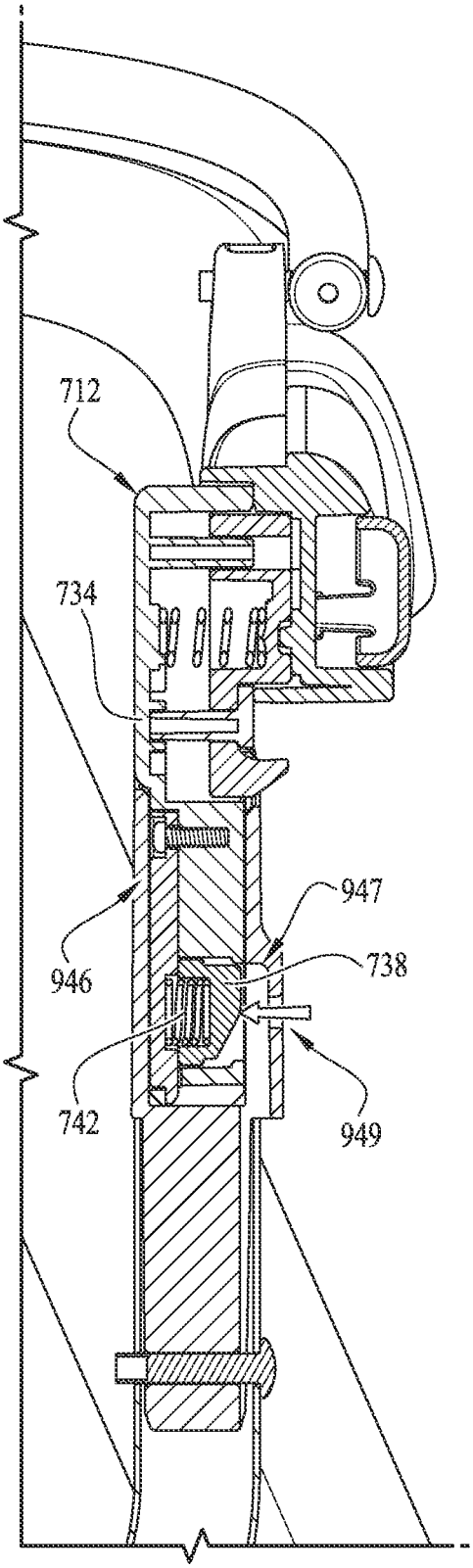

FIGS. 21A and 21B show a detailed view of the inter-engagement between the coupling component 734 of hub 710 and the female coupling socket 812 of the swing-type product base 900 according to example embodiments of the present disclosure. In the depicted embodiment, the hub of the hinge frame is detachably coupled with the female coupling socket of a swing-type product base (also see FIG. 18B). According to example embodiments, a support structure of a swing-type product base 900 comprises an upwardly-extending U-shaped frame member 946 comprising female coupling sockets 948 at each end of the U-shaped frame member for detachably coupling with the coupling components 734 of the hubs 712 of the hinge frame 710. In example embodiments, the coupling component of at least one of the hubs comprises a catch member 738 that is biased by, for example, a spring 742 and configured for complementary engagement with a coupling receiver 947 of the female coupling socket 948 (e.g., of the swing-type product base 900). According to example embodiments, a portion of the female coupling socket 948 comprises a keyed access channel 949 that is in communication with the coupling receiver 947. Accordingly, when the hubs 712 of the hinge frame are detachably coupled with the female coupling sockets 948 of the swing-type product base, the biased catch members 738 are fitted within the coupling receivers 947 thereof such that the hinge frame is prevented from detachment.

According to example embodiments, a tool, key or other detachment member can be provided for actuating the biased catch members 738 to release the same from the coupling receivers 947, and thus, permit disengagement of the hubs from the female coupling sockets 948. For example, the detachment member is generally sized to permit the same to pass through an access channel 949 of the female coupling socket and engage the catch member 738 to displace the same and remove itself from interfering with the coupling receiver. And, should the frame be desired to be folded while the modular cradle assembly is detachably coupled with the swing-type product base 900, the central buttons of the hubs (as described above) can be actuated simultaneously to incrementally adjust the position of either of the first and second U-shaped members 714, 716. Indeed, the female coupling sockets 948 of the swing-type product base 900 are configured so as to not cause interference of the extensions 718 with a portion thereof (as noted for the highchair product base 800), and thus, simultaneous actuation of the central buttons permits the adjustability thereof. Furthermore, it should be noted that while simultaneous actuation of the central buttons 732 when the hinge frame is detachably coupled with the highchair product base 800 permits the detachment thereof, simultaneous actuation of the central buttons 732 while the hinge frame is detachably coupled with the swing-type product base 900 rather permits pivoting of either of the first and second U-shaped portions 714,716, and for example, the biased catch members 738 are to be disengaged from the coupling receivers 947 to permit detachment thereof.

According to example embodiments, the female coupling sockets 812 of the highchair product base 800 preferably provides for coupling engagement with multiple components. For example, as described above, the highchair seat comprises a pair of female coupling sockets 812 configured for detachable coupling engagement with the hubs 712 of the hinge frame 710. Furthermore, the female coupling sockets 812 of the highchair seat are preferably also configured for detachable coupling engagement with a booster seat 1000 (see for example FIG. 32). For example, according to some example embodiments, the highchair product base 800 comprises a booster seat component 1000, which is similarly configured to provide for detachable coupling engagement with the female coupling sockets of the highchair seat.

FIGS. 15A and 15B also show the engagement of a toy bar 750 with a portion of the hinge frame 710 of the modular cradle assembly 700. In example embodiments, the toy bar 750 comprises a male end 752 for fitting within a female receiver 740 that is formed within a portion of the hinge frame 710. According to example embodiments, neither the male end 752 of the toy bar 750 nor the female receiver 740 of the hinge frame 710 comprise any stops or other engagement features that would selectively lock the two together and require manipulation or actuation prior to disengagement. For example, according to example embodiments, to reduce the likelihood that a user or caregiver would use the toy bar 750 as a carry handle, the male end 752 and female receiver 740 merely comprise an interference fit with each other so that the toy bar 750 remains engaged and upright. However, if a large enough amount of force is applied to the toy bar 750 (e.g., grasping the toy bar to carry the entirety of the modular cradle assembly and optionally a product base connected with the modular cradle assembly), the friction of the interference fit (between the male end 752 and female receiver 740) is overcome and the male end 752 of the toy bar 750 becomes disengaged with the female receiver 740, optionally releasing before enough lifting force is applied to lift the cradle. According to one example embodiment, the toy bar 750 disengages from the female receiver 740 when a lifting force of about 5 lbs or more is applied thereto. According to example embodiments, the modular cradle assembly 700 weighs at least about 5 lbs, and thus, attempting to use the toy bar 750 as a handle (e.g., applying a lifting force thereto) merely causes disengagement thereof and does not lift the modular cradle assembly 700 about the support surface. Preferably, the toy bar 750 is pivotable relative to the hinge frame such that the toy bar is temporarily movable (i.e., pivoted) to have unobstructed access to the child-receiving receptacle.

Optionally, the toy bar 750 includes an elongate arcuate stalk having a proximal coupling end for interchangeable attachment to the cradle and/or other accessories, and a correspondingly arcuate and wider flanged distal or free end having one or more attachment features for attachment of toys or other entertainment features to be suspended above and in view of a child positioned in the cradle. According to example embodiments, one or more straps and/or tabs can be provided so as to permit the attachment of one or more toys to the toy bar. According to some example embodiments, the arcuate and wider flanged distal or free end is configured to generally resemble a leaf or other plant-like structure.

Figures 24, 25:
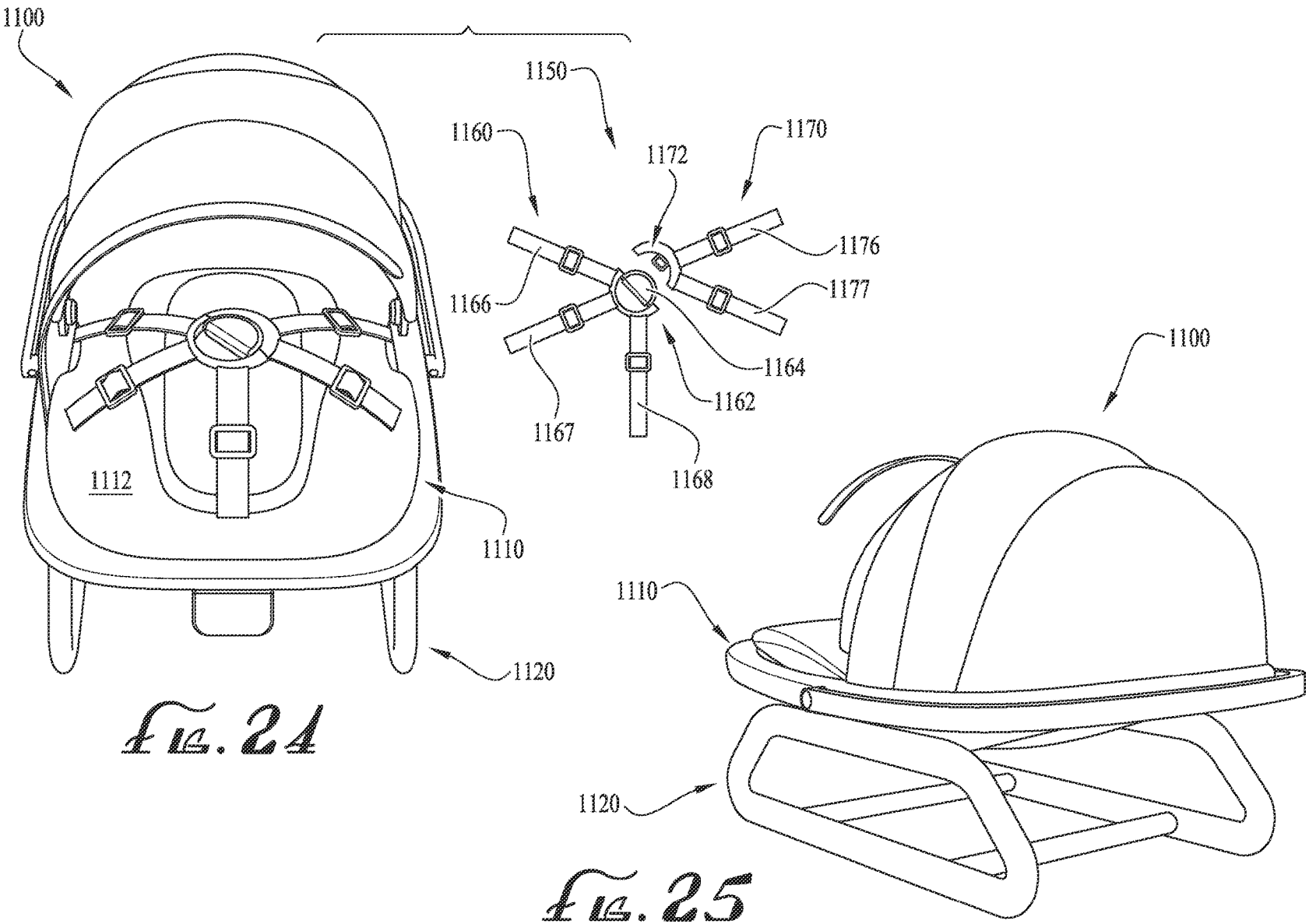
FIGS. 24 and 25 show a modular cradle system mounted to a standalone cradle product base.

FIGS. 24-25 shows a modular cradle assembly 1110 coupled with a standalone product base 1120 according to an example embodiment of the present disclosure. According to example embodiments, a harness 1150 is provided within the child-receiving receptacle 1112 and configured to prevent a child from sliding off or unintentionally removing themselves therefrom. According to example embodiments, the harness 1150 generally comprises two assemblies of components that are releasably engageable. According to example embodiments, the harness comprises a first assembly 1160 and a second assembly 1170. The first assembly 1160 comprises a female buckle portion 1162 having a release button 1164 and comprising a shoulder strap 1166, a waist strap 1167 and a bottom strap 1168 connected therewith and to the child-receiving receptacle 1112 (or to other portions of the modular cradle assembly 1110). The second assembly 1170 comprises a male buckle portion 1172 comprising a shoulder strap 1176 and a waist strap 1177 connected therewith and to the child-receiving receptacle 1112 (or to other portions of the modular cradle assembly 1110). According to example embodiments, the male and female buckle portions 1162, 1172 are preferably configured to detachably coupled with each other. To disconnect the male and female buckle portions, the release button 1164 of the female buckle portion 1162 can either be pushed or pulled, which ultimately allows for the male buckle portion 1172 to be withdrawn from the female buckle portion 1162.

Figure 27:
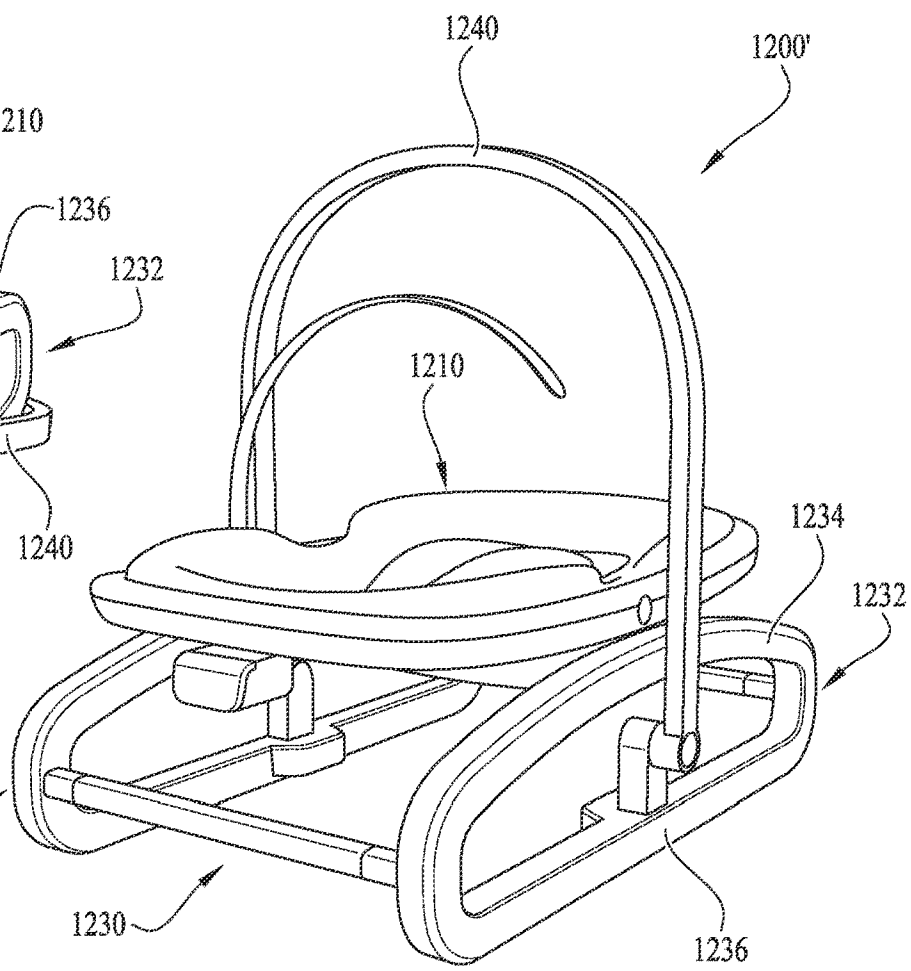
FIG. 27 shows the modular cradle system of FIG. 26 showing a modular cradle assembly mountable to a reversible product base in another example configuration according to an example embodiment of the present disclosure.
Figure 26:
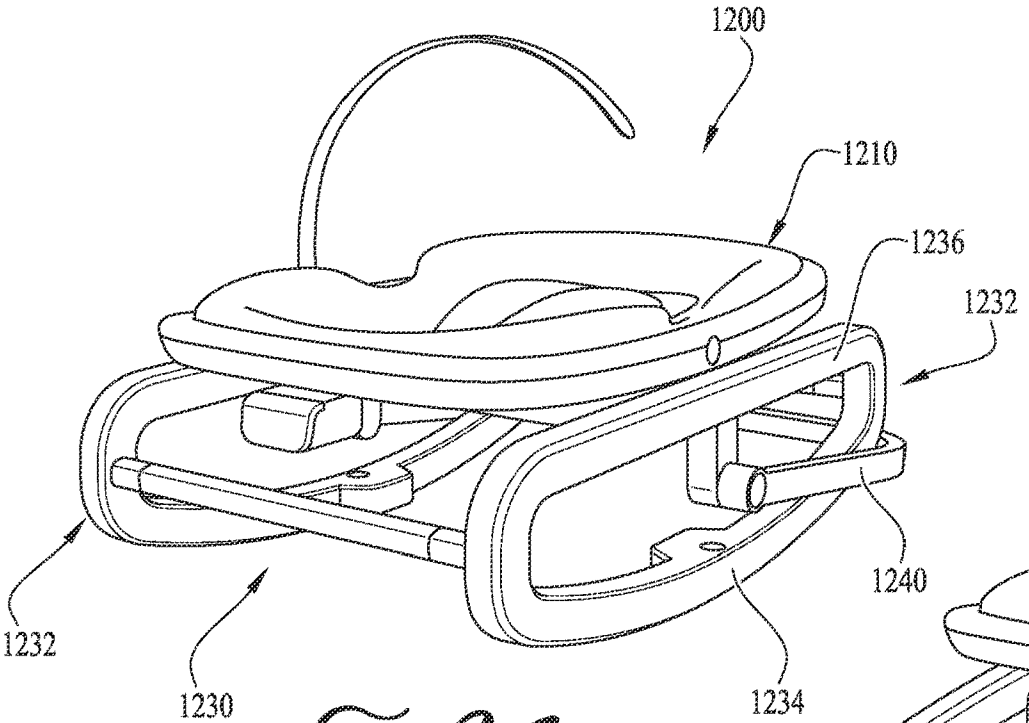
FIG. 26 shows a modular cradle system showing a modular cradle assembly mountable to a reversible product base in one example configuration according to an example embodiment of the present disclosure.

FIG. 26 show a modular cradle system 1200 comprising a modular cradle assembly 1210 coupled with a reversible product base 1230 according to an example embodiment of the present disclosure. In example embodiments, the modular cradle assembly is generally similarly configured as described above, for example, comprising a hinge frame, a child-receiving receptable detachably coupled to the hinge frame, and at least one hub for complementary engagement with at least one female receiving socket of the reversible product base. According to example embodiments, the reversible product base 1230 preferably comprises a pair of spaced-apart frame members 1232, for example, wherein when a first side of the spaced-apart frame members 1232 comprise curved or arcuate frame portions 1234 and wherein a second side of the spaced-apart frame member 1232 comprise generally flat and planar frame portions 1236. As such, the modular cradle assembly 1200 is capable of rocking when the curved frame portions are in contact with the floor. Alternatively, as shown in FIG. 27, the modular cradle assembly 1200' is capable of remaining stable when the planar frame portions 1236 are in contact with the floor. Preferably, according to example embodiments, the reversible product base can comprise two pairs of female receiving sockets so that the modular cradle assembly can be detachably coupled with either side of the reversible product base.

Figure 28:
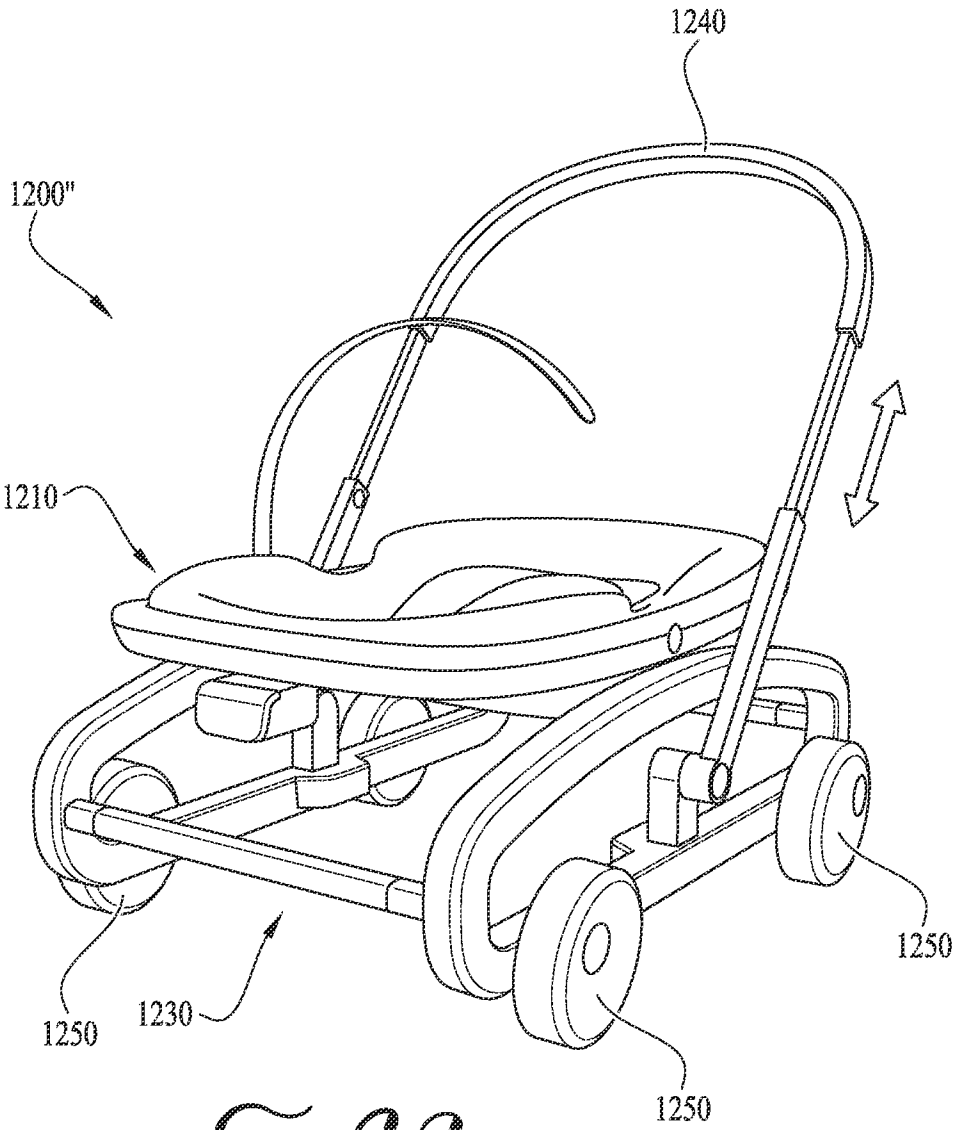
FIG. 28 shows the modular cradle system of FIG. 26 showing a modular cradle assembly mountable to a reversible product base in yet another example configuration according to an example embodiment of the present disclosure.

According to another example embodiment of the present disclosure, a rocking arm or movement device can be provided on or near the first side of the spaced-apart frame members comprising the curved frame portions, for example, so as to impart a rocking motion to the reversible product base. According to example embodiments, a button, switch or actuatable member can be provided to selectively power the rocking arm. FIGS. 26-28 show the modular cradle assembly 1210 detachably coupled to both the first (rocker mode) and second sides (standalone mode) of the spaced-apart frame portions. According to example embodiments, the modular cradle assembly 1210 and/or reversible product base 1230 can be of a desired color or can comprise one or more accented members or components, for example, a color or wood accented component according to some example embodiments. According to some example embodiments, a customer who is ordering a modular cradle assembly (or desired product base) can choose the coloring, accenting, and/or other optional features and accessories as desired. Thus, according to example embodiments, the modular cradle assembly (and any product bases) can be customized per the customer's liking.

As further depicted in FIGS. 26-28, a carrying handle 1240 can be provided with the reversible product base 1230. Preferably the carrying handle is pivotable between a front, collapsed position; an upright, erect position (see FIG. 27); and a rear, collapsed position (see FIG. 26). According to some example embodiments, the reversible base product 1200" can comprise wheels 1250 mounted on the second side thereof, for example, such that the reversible product base 1230 can act as a stroller or a rocker. FIG. 28 shows the modular cradle assembly 1210 coupled with the reversible product base 1230 and configured as a stroller wherein the pivotable carrying handle 1240 is configured for pushing or pulling the reversible product base and modular cradle assembly coupled therewith. In example embodiments, the carrying handle 1240 is expandable or extendable such that the same can be lengthened when it is desired to function as a stroller or, for example, can be compacted such that the same can function as a carrying handle.

Figure 30:
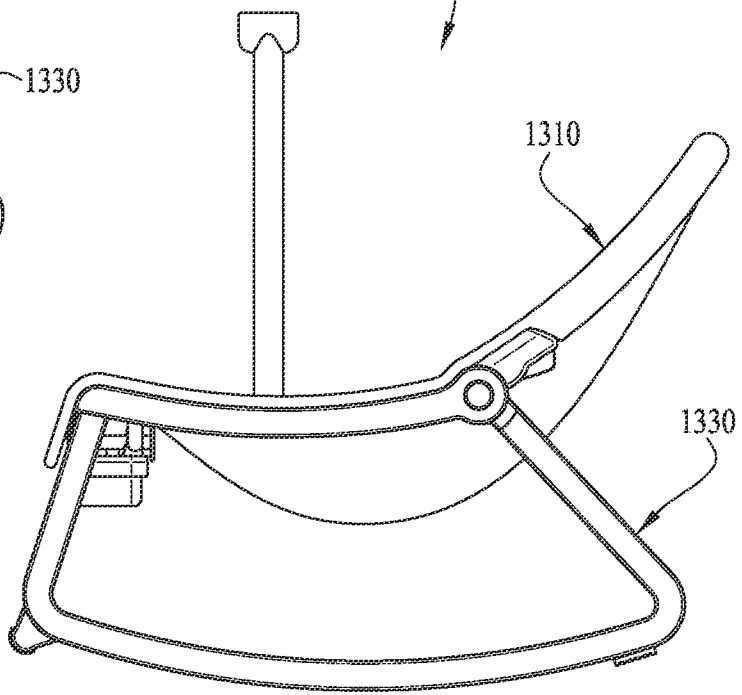
FIGS. 29 and 30 show a modular cradle assembly detachably coupled with a rocker product base which is configured to receive a modular toy bar according to an example embodiment of the present disclosure.
Figure 29:
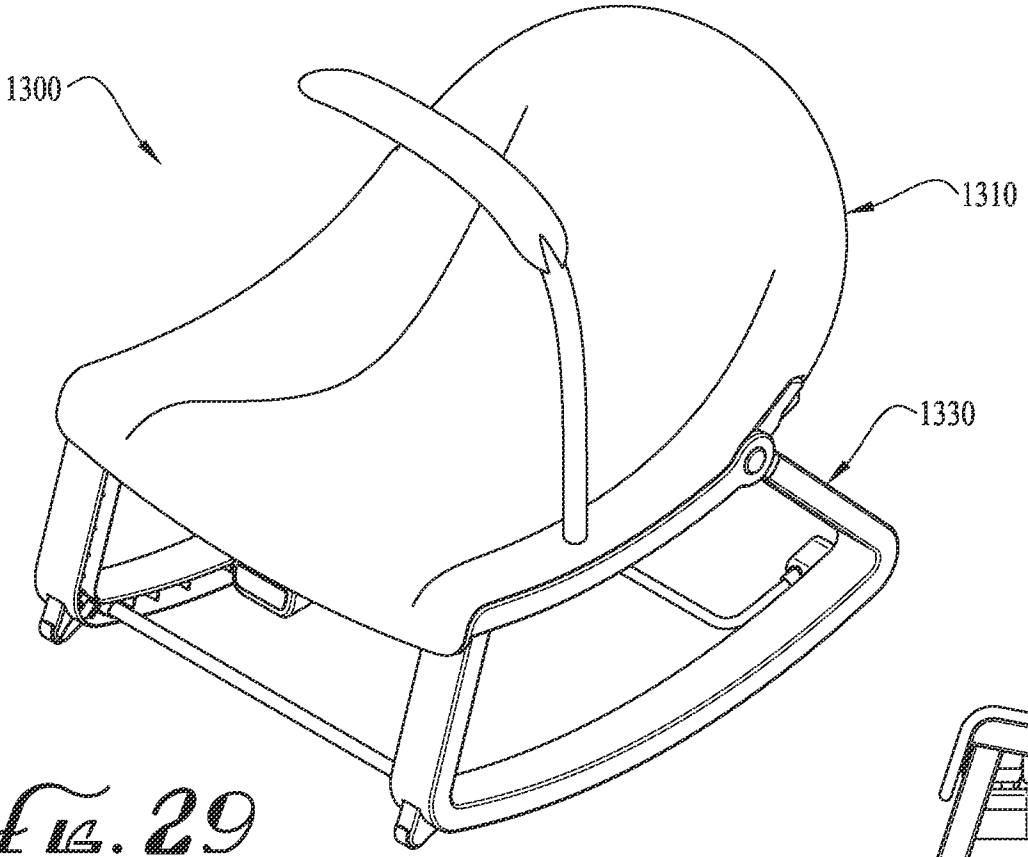
Figure 32:
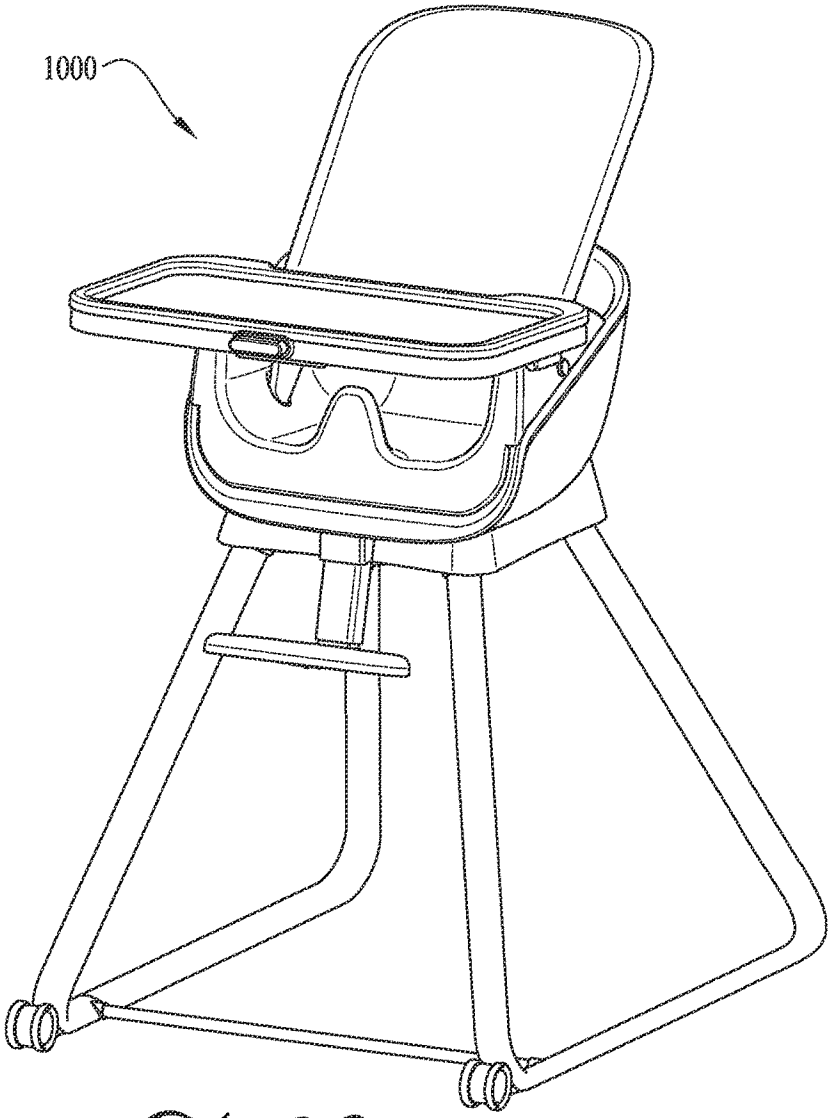
FIGS. 31 and 32 show a highchair outfitted with a booster seat which is configured to receive a modular toy bar according to an example embodiment of the present disclosure.
Figure 31:
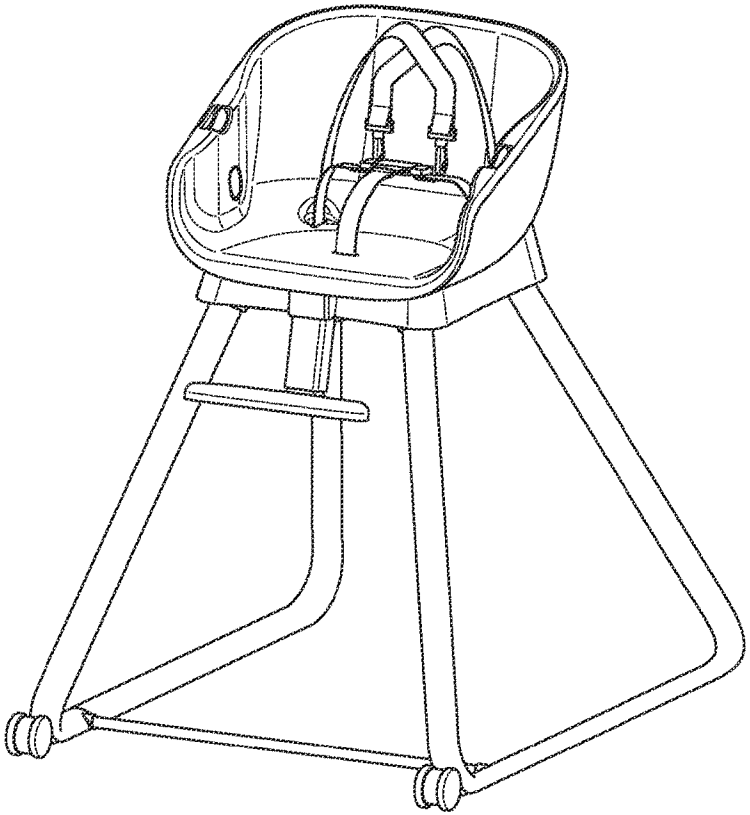

FIGS. 29-30 show a modular cradle system 1300 comprising a modular cradle assembly 1310 detachably coupled with a rocker product base 1330 and FIGS. 31-32 shows a highchair outfitted with a booster seat, both of which are configured to receive a modular toy bar according to an example embodiment of the present disclosure.

According to yet other example embodiments of the present disclosure, the modular cradle assembly as described herein can preferably be configured for detachably coupling with various product bases of the children's products. For example, the modular cradle assembly can be configured for detachable coupling engagement with product bases such as a rocker, bouncer, jumper, bassinet, highchair, swing, play yard and/or various other product bases as desired. According to one example embodiment, the modular cradle assembly can be configured for removable attachment to a changing table, activity center, crib, stroller frame and/or other desired product base.

While the disclosed inventions have been described with reference to example embodiments, it will be understood by those skilled in the art that a variety of modifications, additions and deletions are within the scope of invention, as defined by the following claims.

What is claimed is:

1. A modular system of children's gear comprising:
- a first gear product;
- a second gear product;
- a cradle configured for interchangeable use in a first configuration detachably coupled to the first gear product, and in a second configuration detachably coupled to the second gear product, the cradle comprising a frame and a support panel mounted to the frame, wherein the frame is foldable in the first configuration when coupled to the first gear product, and wherein the frame is not foldable in the second configuration when coupled to the second gear product.

2. The modular system of claim 1, wherein the first gear product is a swing.

3. The modular system of claim 1, wherein the second gear product is a highchair.

4. The modular system of claim 1, wherein the cradle comprises first and second frame portions pivotally coupled to a pair of spaced-apart hub members, the hub members comprising coupling components for detachable coupling engagement with female receiving sockets of the first and second gear products.

5. The modular system of claim 4, wherein at least one of the hub members comprises a first actuatable button configured for disengaging the coupling component from the female receiving socket of the first gear product and a second actuatable button configured for disengaging the coupling component from the female receiving socket of the second gear product.

6. The modular system of claim 5, wherein the first actuatable button is accessed through a key passage on the first gear product.

7. The modular system of claim 1, further comprising a toy bar releasably connected to the frame of the cradle.

8. A cradle for a modular system of children's gear, the cradle comprising:
- a frame comprising a plurality of frame elements and at least one hinged coupling between a first frame element and a second frame element;
- a support panel mounted to the frame;
- coupling means for interchangeably mounting the frame to a first gear product and a second gear product; and
- an interference member for allowing the hinged coupling of the frame to fold when the cradle is coupled to the first gear product, and for preventing the hinged coupling of the frame from folding when the cradle is coupled to the second gear product.

9. The cradle of claim 8, wherein the first gear product is a swing-type product.

10. The cradle of claim 8, wherein the second gear product is a highchair.

11. The cradle of claim 8, wherein the interference member is an extension of at least one of the plurality of frame elements.

12. The cradle of claim 8, wherein the at least one hinged coupling comprises a first release button to disengage the hinged coupling from the first gear product and a second release button to disengage the hinged coupling from the second gear product.

13. The cradle of claim 8, further comprising a toy bar detachably connected to the at least one hinged coupling.

14. A modular cradle system comprising:
- a modular cradle assembly comprising a hinge frame and a support panel mounted to the hinge frame;
- a reversible product base that is reconfigurable between at least two modes of functionality,
- wherein the modular cradle assembly detachably couples with the reversible product base in a first configuration to provide a first function, and wherein the modular cradle assembly detachably couples with the reversible product base in a second configuration to provide a second function, and wherein the modular cradle assembly is separable from the reversible product base.

15. The modular cradle assembly of claim 14, wherein the reversible product base comprises a pair of spaced-apart frame members, a first side of the spaced-apart frame members being generally curved for rocking on a floor surface, and a second side of the spaced-apart frame members being generally planar for remaining stable on the floor surface.

16. The modular cradle assembly of claim 14, further comprising at least one wheel rotatably secured to the reversible product base.

17. The modular cradle assembly of claim 16, wherein the modular cradle assembly detachably couples with the reversible product base in a third configuration to provide a third function.

18. The modular cradle assembly of claim 17, wherein the third function is a stroller.

19. The modular cradle assembly of claim 14, wherein the support panel is detachably mounted to the hinge frame.

* * * * *